US007329849B2

(12) United States Patent
Kasai

(10) Patent No.: US 7,329,849 B2
(45) Date of Patent: Feb. 12, 2008

(54) ELECTRONIC CIRCUIT, METHOD OF DRIVING ELECTRONIC CIRCUIT, ELECTRO-OPTICAL DEVICE, AND ELECTRONIC APPARATUS

(75) Inventor: Toshiyuki Kasai, Okaya (JP)

(73) Assignee: Seiko Epson Corporation, Tokyo (JP)

( * ) Notice: Subject to any disclaimer, the term of this patent is extended or adjusted under 35 U.S.C. 154(b) by 41 days.

(21) Appl. No.: 11/279,810

(22) Filed: Apr. 14, 2006

(65) Prior Publication Data

US 2006/0231740 A1 Oct. 19, 2006

(30) Foreign Application Priority Data

Apr. 19, 2005 (JP) ..... 2005-120771

(51) Int. Cl.
*H01J 40/14* (2006.01)

(52) U.S. Cl. ..... 250/214 R; 250/208.1

(58) Field of Classification Search ..... 250/214 R, 250/208.1, 214 LS, 214.1; 257/290, 291, 257/292, 440; 348/308, 310; 345/80, 81, 345/88, 76

See application file for complete search history.

(56) References Cited

U.S. PATENT DOCUMENTS 7,071,906 B2 * 7/2006 Nishitani et al. ..... 345/81

OTHER PUBLICATIONS

'2001FPD Technology Outlook', Electronic Journal, p. 749 to 750, 2001 (with translation).

* cited by examiner

*Primary Examiner*—Que T Le
(74) *Attorney, Agent, or Firm*—Oliff & Berridge, PLC

(57) ABSTRACT

There is provided a method of driving an electronic circuit. The electronic circuit includes a light-emitting element that is interposed between a first electric supply line and a second electric supply line having different potentials and emits light by the supply of a current, a storage capacitor that holds a voltage between a first electrode and a second electrode, and a driving transistor that is interposed between the first electric supply line and the second electric supply line and has a gate terminal connected to the first electrode of the storage capacitor. The method includes: for a first period, applying a data potential according to a gray-scale level designated for the light-emitting element to the second electrode of the storage capacitor while electrically connecting an initialization wiring line supplied with an initialization potential to the first electrode of the storage capacitor; and for a second period subsequent to the first period, electrically connecting the second electrode of the storage capacitor to a source terminal of the driving transistor.

16 Claims, 28 Drawing Sheets

Tinit [INITIALIZE]

Twrt [DATA WRITE]

Tdsp [DISPLAY]

Tinit [INITIALIZE]

Twrt [DATA WRITE]

Tdsp [DISPLAY]

ELECTRONIC CIRCUIT, METHOD OF DRIVING ELECTRONIC CIRCUIT, ELECTRO-OPTICAL DEVICE, AND ELECTRONIC APPARATUS

BACKGROUND

1. Technical Field

The present invention relates to a technology for controlling behavior of a light-emitting element, such as an organic light-emitting diode element (hereinafter, referred to as 'OLED' element) or the like.

2. Related Art

In general, electro-optical devices, in which a light-emitting element, such as an OLED element or the like, is used, have been suggested as display devices of various electronic apparatuses. This kind of electro-optical device has a structure in which a plurality of pixel circuits, each of which has a light-emitting element, are disposed in a matrix. Each of the pixel circuits controls a current supplied to the light-emitting element.

FIG. 28 is a circuit diagram illustrating a structure of one pixel circuit in an electro-optical device according to the related art (for example, see '2001FPD Technology Outlook', Electronic Journal, p 749 to 750). As shown in FIG. 28, a pixel circuit P0 includes a p-channel-type transistor Tdr (hereinafter, referred to as 'driving transistor') that is interposed between a power supply line 31 and a ground line 32, and a light-emitting element 17. Each of the power supply line 31 and the ground line 32 is commonly connected to the plurality of pixel circuits P0 that are disposed in a matrix. A high-side potential VH of a power supply, which is generated by a power supply circuit (not shown), is supplied to each pixel circuit P0 through the power supply line 31, and a low-side potential VL, which is generated by the power supply circuit, is supplied to each pixel circuit P0 through the ground line 32.

As shown in FIG. 28, a gate terminal of the driving transistor Tdr is connected to a first terminal of a capacitor element C0 and a drain terminal of an n-channel-type transistor Ts1 (hereinafter, referred to as 'selecting transistor'). A second terminal of the capacitor element C0 is connected to the power supply line 31. In the meantime, the selecting transistor Ts1 is a switching element that controls an electrically conductive state and an electrically non-conductive state between a data line 13 and the first terminal of the capacitor element C0 in accordance with a level of a scanning signal Ssel. The data line 13 is supplied with a potential Vdata hereinafter, referred to as 'data potential') which corresponds to a gray-scale level designated for each pixel circuit P0.

In this configuration, if the selecting transistor Ts1 shifts an off state to an on state by the scanning signal Ssel, the corresponding data potential Vdata is supplied to a gate terminal of the driving transistor Tdr, and then held in the capacitor element C0. In addition, a current Ie1, which flows through the ground line 32 from the power supply line 31 via the driving transistor Tdr and the light-emitting element 17, is controlled in accordance with a voltage herd in the capacitor element C0. Accordingly, the light-emitting element 17 emits light with a gray-scale level (luminance) according to the data potential Vdata.

In the meantime, due to a resistance being generated in the power supply line 31, in the potential VH supplied to each pixel circuit P0, the voltage drop according to the location of the corresponding pixel circuit P0 (specifically, length of a path from the power supply circuit to the pixel circuit P0) is generated. Accordingly, the potentials VH supplied to the respective pixel circuits P0 are different from each other while depending on the corresponding locations of the respective pixel circuits P. In addition, there is a problem in that a gray-scale level of a light-emitting element 17 of each pixel circuit PD may vary due to the difference between the potentials VH. This problem will be described in detail below.

In FIG. 28, if a driving transistor Tdr operates in a saturation region, a current supplied to the light-emitting element 17 is represented by the following Equation (A1)

$$Ie1=(1/2)\beta(Vgs-Vth)^2 \quad \text{[Equation A1]}$$

In this case, in Equation (A1), 'β' indicates a gain coefficient of the driving transistor Tdr, 'Vgs' indicates a voltage between a gate terminal and a source terminal of the driving transistor Tdr, and 'Vth' indicates a threshold voltage of the driving transistor Tdr. A voltage Vgs when the selecting transistor Ts1 is turned off becomes the difference between the potential VH of the power supply line 31 and the data potential Vdata (Vgs=VH−Vdata). Therefore, Equation (A1) is changed to the following Equation (A2).

$$Ie1=(1/2)\beta(VH-Vdata-Vth)^2 \quad \text{[Equation A2]}$$

As such, in the structure shown in FIG. 28, the current Ie1 that actually flows through the light-emitting element 17 (and a gray-scale level according to the current Ie1) depends on the potential VH of the power supply line 31. Therefore, it becomes difficult for the plurality of light-emitting elements 17 to emit light in accordance with a common gray-scale level. As a result, even if the same data potential Vdata is supplied to the pixel circuits P0, the potentials VH supplied to the respective pixel circuits P0 may be different from each other due to the voltage drop in the power supply line 31. Due to this, the current Ie1 that actually flows through the respective light-emitting elements 17 varies, so that the luminance is different for every light-emitting element 17.

SUMMARY

An advantage of some aspects of the invention is that it provides an electronic circuit which is capable of preventing a gray-scale level of each light-emitting element from varying due to the voltage drop in a power supply line, a method of driving an electronic circuit, an electro-optical device, and an electronic apparatus.

According to a first aspect of the invention, there is provided a method of driving an electronic circuit, the electronic circuit including a light-emitting element that is interposed between a first electric supply line (for example, a power supply line 31) and a second electric supply line (for example, a ground line 32) having different potentials and emits light by the supply of a current, a storage capacitor that holds a voltage between a first electrode and a second electrode, and a driving transistor that is interposed between the first electric supply line and the second electric supply line and has a gate terminal connected to the first electrode of the storage capacitor. The method includes: for a first period (for example, an initialization period Tinit and a writing period Twrt, or a writing period Twrt), applying a data potential according to a gray-scale level designated for the light-emitting element to the second electrode of the storage capacitor while electrically connecting an initialization wiring line supplied with an initialization potential to the first electrode of the storage capacitor; and for a second period subsequent to the first period (for example, a display period Tdsp), electrically connecting the second electrode of the storage capacitor to a source terminal of the driving transistor. According to this aspect, since the current supplied to the light-emitting element does not depend on the potential of the first electric supply line or the potential of the second electric supply line, it is possible to prevent a gray-scale level of the light-emitting element from being irregular due to the voltage drop in the first electric supply line or the second electric supply line (for example, display irregularities can be prevented in a display device in which an electronic circuit is used as a pixel).

Preferably, the initialization potential is set to a level which allows the driving transistor to be turned off. According to this aspect, for the first period when the initialization potential is supplied to the gate terminal of the driving transistor, since the driving transistor can be continuously turned off, it is possible to surely stop the light emission of the light-emitting element for the first period. Therefore, high definition display can be achieved, and a consumed power can be reduced.

According to a second aspect of the invention, there is provided an electronic circuit. The electronic circuit (for example, a pixel circuit used in the display device) includes: a light-emitting element that is interposed between a first electric supply line and a second electric supply line having different potentials and emits light by the supply of a current; a storage capacitor that holds a voltage between a first electrode and a second electrode; a driving transistor that is interposed between the first electric supply line and the second electric supply line and has a gate terminal connected to the first electrode of the storage capacitor; a selecting switching element (for example, a selecting transistor Ts1 in the embodiment) that switches an electrically conductive state and an electrically non-conductive state between a data line and the second electrode of the storage capacitor, the data line being supplied with a data potential according to a gray-scale level designated for the light-emitting element; a first switching element that switches an electrically conductive state and an electrically non-conductive state between a first terminal and a second terminal, the first terminal being connected to an initialization wiring line supplied with an initialization potential, the second terminal being connected to the first electrode of the storage capacitor; and a second switching element that switches an electrically conductive state and an electrically non-conductive state between a first terminal and a second terminal, the first terminal being connected to the second electrode of the storage capacitor, the second terminal being connected to a source terminal of the driving transistor. According to this aspect, it is possible to prevent a gray-scale level of the light-emitting element from being irregular due to the voltage drop in the first electric supply line or the second electric supply line. Further, preferably, the initialization potential is set to a level which allows the driving transistor to be turned off. According to this aspect, for the first period when the initialization potential is supplied to the gate terminal of the driving transistor, since the driving transistor can be continuously turned off, it is possible to surely stop the light emission of the light-emitting element for the first period.

Preferably, each of the driving transistor, the selecting switching element, the first switching element, and the second switching element is composed of an n-channel-type transistor. According to this structure, the electronic circuit can be constructed by a thin film transistor in which amorphous silicon is used for a material of a semiconductor layer. However, a channel type of each switching element or a material of the semiconductor layer may be arbitrarily changed.

Preferably, the selecting switching element is turned on for a part (for example, the writing period Twrt in a case in which the first period has the initialization period Tinit and the writing period Twrt) or all (for example, the writing period Twrt in a case in which the first period has only the writing period Twrt) of a first period in accordance with a scanning signal supplied to the corresponding selecting switching element and turned off for a second period subsequent to the first period. Further, the first switching element is turned on for the first period in accordance with a first control signal supplied to the corresponding first switching element and turned off for the second period. Further, the second switching element is turned off for the first period in accordance with a second control signal supplied to the corresponding second switching element and turned on for the second period. Preferably, the first switching element is turned on for both an initialization period and a writing period right after the initialization period, all of which are included in the first period, and the selecting switching element is turned off for the initialization period and turned on for the writing period. According to this aspect, since the gate terminal of the driving transistor is supplied with the initialization potential right before the second period, it is possible to surely prevent the gray-scale level from being irregular due to the voltage drop in each electric supply line.

Further, in the electronic circuit according to the aspect of the invention, at least one of signals for controlling the respective switching elements serves as a signal for controlling another switching element. For example, the scanning signal may be supplied to the selecting switching element and to the first switching element as the first control signal. According to this structure, the configuration can be simplified, as compared with a case in which each of the selecting switching element and the first switching element is controlled by an individual signal. The specific examples of this aspect may be described below as a second embodiment (FIG. 5) and a first aspect (FIG. 15) of a fifth embodiment.

Preferably, each of the first switching element and the second switching element is composed of a different channel type transistor, and the first control signal is supplied to the first switching element and to the second switching element as the second control signal. According to this aspect, the configuration can be simplified, as compared with a case in which each of the first switching element and the second switching element is controlled by an individual signal. The specific example of this aspect may be described below as a second aspect (FIG. 16) of a fifth embodiment.

Preferably, each of the second switching element and the selecting switching element is composed of a different channel type transistor, and the scanning signal is supplied to the selecting switching element and to a gate terminal of the second switching element as the second control signal. According to this aspect, the configuration can be simplified, as compared with a case in which each of the selecting switching element and the second switching element is controlled by an individual signal. The specific example of this aspect may be described below as a third aspect (FIG. 19) of a fifth embodiment.

Preferably, the second switching element is composed of a different channel type transistor from the selecting switching element and the first switching element, and the scanning signal is supplied to the first switching element as the first control signal and to the second switching element as the second control signal. According to this aspect, the configuration can be simplified, as compared with a case in which each of the second switching element, the selecting switching element, and the first switching element is controlled by an individual signal. The specific example of this aspect may be described below as a fourth aspect (FIG. 20) of a fifth embodiment.

In this configuration, a signal for controlling each of the switching elements (the selecting switching element, the first switching element, and the second switching element) also serves as the initialization potential. Preferably, the scanning signal is supplied to the selecting switching element and to the initialization writing line as the initialization potential. The specific example of this aspect may be described below as a fifth aspect (FIG. 22) and a sixth aspect (FIG. 24) of a fifth embodiment. Preferably, the second control signal is supplied to the second switching element and to the initialization wiring line as the initialization potential. The specific example of this aspect may be described below as a third embodiment (FIG. 8). According to this aspect, the configuration can be simplified, as compared with a case in which the initialization potential is generated separately from each signal.

According to a third aspect of the invention, there is provided an electro-optical device which includes: a plurality of the electronic circuits, which are disposed in a plane; and a driving circuit that drives each of the electronic circuits so as to allow the light-emitting element to emit light. As described above, according to this structure, since the irregularity of the luminance of each light-emitting element is prevented, when an electro-optical device using this electronic circuit is used for a display device, high definition display can be achieved.

Preferably, the selecting switching element of each electronic circuit is turned on for a part or all of a first period in accordance with a scamming signal supplied from the driving circuit and turned off for a second period subsequent to the first period, and a scanning signal, which is supplied from the driving circuit to a selecting switching element of one electronic circuit, is supplied to an initialization wiring line of another electronic circuit as the initialization potential. According to this aspect, the configuration can be simplified, as compared with a structure in which the initialization potential is generated separately from the signal for controlling each switching element. The specific example of this aspect may be described below as a fourth embodiment (FIG. 11).

According to a fourth aspect of the invention, there is provided an electronic apparatus including the above-mentioned electro-optical device. Examples of this electronic apparatus may include a personal computer, a cellular phone, or the like. However, the electro-optical device according to the aspect of the invention is not limited to only the image display. For example, the electro-optical device according to the aspect of the invention can be applied to an exposure device in which a latent image is formed on an image carrier, such as a photoreceptor drum or the like, by irradiating a light ray.

BRIEF DESCRIPTION OF THE DRAWINGS

The invention will be described with reference to the accompanying drawings, wherein like numbers reference like elements, and wherein.

DESCRIPTION OF EXEMPLARY EMBODIMENTS

First Embodiment

Figure 1:
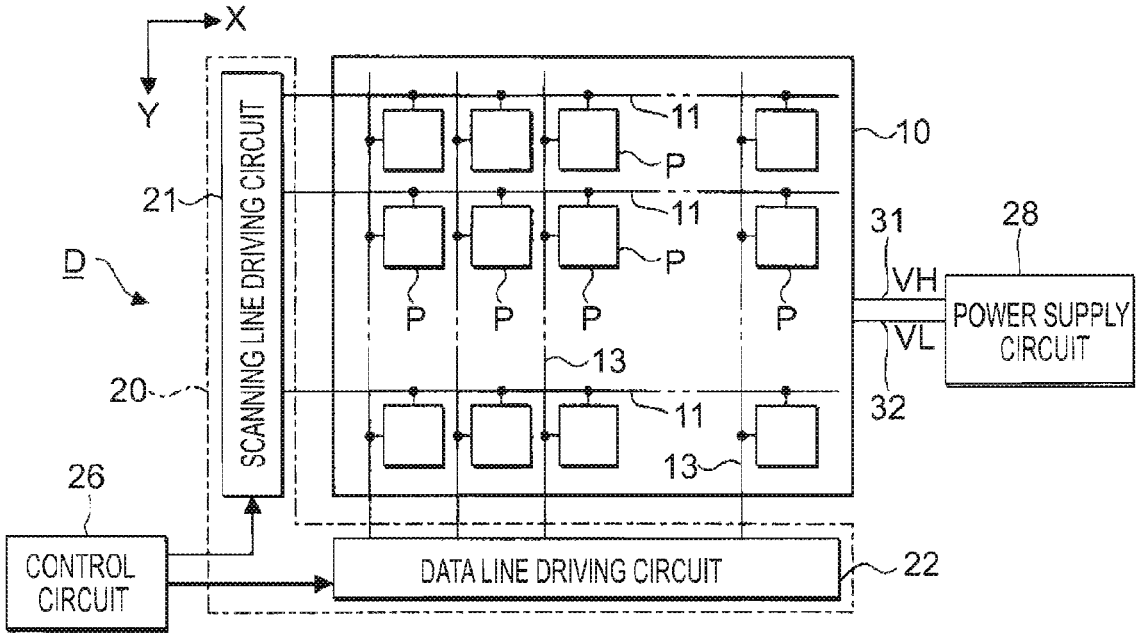
FIG. 1 is a block diagram illustrating a structure of an electro-optical device according to a first embodiment of the invention.

FIG. 1 is a block diagram illustrating a structure of an electro-optical device according to a first embodiment of the invention. An electro-optical device D (serving as an image display unit) is used in various electronic apparatuses. Specifically, the electro-optical device D includes a substrate 10 on which a plurality of pixel circuits P are disposed, a driving circuit 20 that drives the respective pixel circuits P, a control circuit 26 that controls the operation of the driving circuit 20, and a power supply circuit 28 that supplies a power to the respective units. All or a part of each of the driving circuit 20, the control circuit 26, and the power supply circuit 28 is mounted on a wiring board (not shown) that is bonded to the substrate 10. However, an IC chip, on which these circuits are mounted, may be mounted on the surface of the substrate 10 or these circuits may be mounted by means of thin film transistors that are formed on the surface of the substrate 10.

As shown in FIG. 1, on the surface of the substrate 10, m control lines 11 that extend in an X direction, and n data lines 13 that extend in a Y direction orthogonal to the X direction are formed (in this case, each of m and n is a natural number). A plurality of pixel circuits P are disposed at locations corresponding to intersections between the plurality of control lines 11 and the plurality of data lines 13. Accordingly, these pixel circuits P are disposed in a matrix of m rows in a longitudinal direction x n columns in a horizontal direction.

The driving circuit 20 has a scanning line driving circuit 21, to which m control lines 11 are connected, and a data line driving circuit 22 to which n data lines 13 are connected. The scanning line driving circuit 21 selects the plurality of pixel circuits P for each row for each horizontal scanning period to operate the plurality of pixel circuits P. In the meantime, for each horizontal scanning period, the data line driving circuit 22 generates a data potential Vdata of each of the pixel circuits P corresponding to one row (n pixel circuits) selected by the scanning line driving circuit 21, and outputs it to each data line 13. The data potential Vdata, which is supplied to the pixel circuit P through the data line 13, is a potential according to a gray-scale level (luminance) that is designated for the corresponding pixel circuit P. A gray-scale level of each of the pixel circuits P is designated by image data supplied from the control circuit 26.

The control circuit 26 controls the scanning line driving circuit 21 and the data line driving circuit 22 by the supply of various control signals, such as clock signals or the like, which define a horizontal scanning period or a vertical scanning period, and outputs the image data designating the gray-scale Level of each pixel circuit P to the data line driving circuit 22. In the meantime, the power supply circuit 28 generates a high-side potential VH and a low-side potential VL (ground potential) of a power supply so as to supply them to the respective units in the electro-optical device D. The high-side potential VH, which is generated by the power supply circuit 28, is supplied to the respective pixel circuits P though the power supply line 31 that is commonly connected to the entire pixel circuits P. At the same time, the low-side potential VL, which is generated by the power supply circuit 28, is supplied to the respective pixel circuits P though the ground line 32 that is commonly connected to the entire pixel circuits P. In the present embodiment, the power supply circuit 28 generates a predetermined potential Vinit (hereinafter, referred to as 'initialization potential') The initialization potential Vinit corresponds to a predetermined potential that is used for initializing a state of each pixel circuit P. The initialization potential Vinit is supplied to the respective pixel circuits P through an initialization wiring line 35 (see FIG. 2) that is commonly connected to the entire pixel circuits P.

Figure 2:
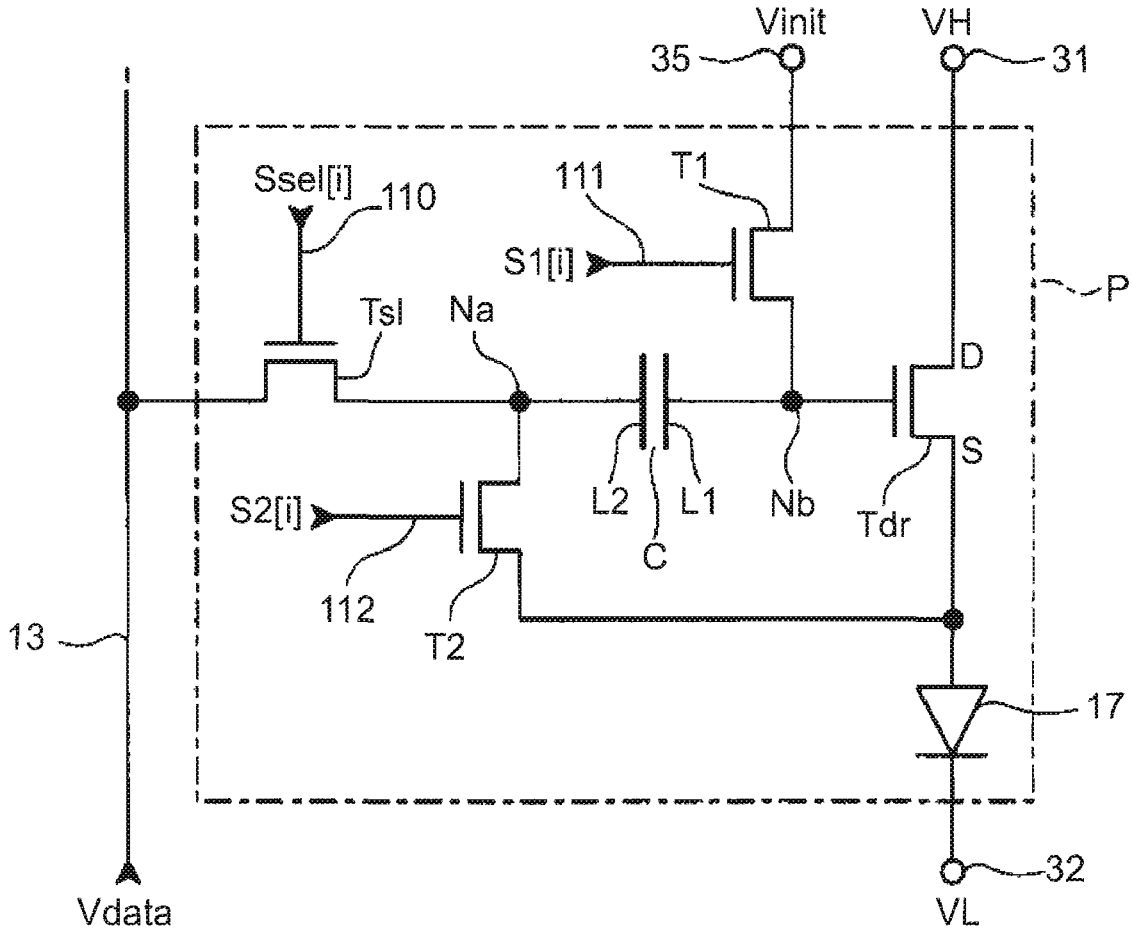
FIG. 2 is a circuit diagram illustrating a structure of each pixel circuit.

Next, FIG. 2 is a circuit diagram illustrating a structure of each of the pixel circuits P. In FIG. 2, only a structure of one pixel circuit P of a j-th column (is an integer which satisfies the condition $1 \leqq j \leqq n$), which belongs to an i-th row (i is an integer which satisfies the condition $1 \leqq i \leqq m$), is shown, but the other pixel circuits P have the same structure.

As shown in FIG. 2, each of the pixel circuits P has a driving transistor Tdr and a light-emitting element 17 that are interposed between the power supply line 31 and the ground line 32. The light-emitting element 17 is a current driven element that emits light with luminance according to a current supplied to the corresponding light-emitting element 17, and has a structure in which a light-emitting layer made of an organic EL material is interposed between an anode and a cathode. The cathode of the light-emitting element 17 is connected to the ground line 32. In the meantime, the driving transistor Tdr is an n-channel-type thin film transistor that control the current supplied to the light-emitting element 17. Further, in driving transistor Tdr, a drain terminal is connected to the power supply line 31, and a source terminal is connected to the anode of the light-emitting element 17.

As shown in FIG. 2, the control line 11, which is shown in FIG. 1 as one wiring line for convenience, has the scanning line 110, a first control line 111, and a second control line 12. The scanning line 110 of each control line 11 is supplied with scanning signals Ssel [1] to Ssel [m] so as to select pixel circuits P of each row. In addition, the first control line 111 of each control line is supplied with first control signals S1 [1] to S1 [m] so as to define a period in which light emission of the light-emitting element 17 is prepared (an initialization period Tinit and a writing period Twrt which will be described in detail below), and the second control line 112 of each control line is supplied with second control signals S2 [1] to S2 [m] so as to define a period in which light emission of the light-emitting element 17 is actually allowed (a display period Tdsp which will be described in detail below). In addition, a specific waveform of each signal or the operation of the pixel circuit P according to it will be described in detail below.

A storage capacitor C shown in FIG. 2 is a capacitor that holds a voltage between a first electrode L1 and a second electrode L2. The gate terminal of the driving transistor Tdr is connected to the first electrode L1 of the storage capacitor C at a connection point Nb. In addition, the second electrode L2 of the storage capacitor C is connected to a source terminal of the selecting transistor Ts1 at the connection point Na. The selecting transistor Ts1 is an n-channel-type thin film transistor whose drain terminal is connected to the data line 13 and whose gate terminal is connected to the scanning line 110. Further, the selecting transistor Ts1 serves as a switching element that switches an electrically conductive state and an electrically non-conductive state between the data line 13 and the second electrode L2 of the storage capacitor C. That is, for a period when the scanning signal Ssel [i] becomes a high level, the selecting transistor Ts1 is turned on, so that the data line 13 is electrically connected to the second electrode L2 of the storage capacitor C. In contrast, for a period when the scanning signal Ssel [i] becomes a low level, the selecting transistor Ts1 is turned off, so that the data line 13 is electrically insulated from the second electrode L2 of the storage capacitor C. That is, the selecting transistor Ts1 serves as a control unit that controls whether the data potential Vdata is supplied to the second electrode L2 of the storage capacitor C.

The source terminal of the first switching element T1 is connected to a connection point Nb between the first electrode L1 of the storage capacitor C and the gate terminal of the driving transistor Tdr. In this case, the first switching element T1 is an n-channel-type thin film transistor whose drain terminal is connected to the initialization wiring line 35 and whose gate terminal is connected to the first control line 111, and serves as a switching element that switches an electrically conductive state and an electrically non-conductive state between the connection point Nb and the initialization wiring line 35. That is, for a period when the first control signal S1 [i] becomes a high level, the first switching element T1 is turned on, so that the initialization potential Vinit is supplied to the connection point Nb. In contrast, for a period when the first control signal S1 [i] becomes a low level, the first switching element T1 is turned off, so that the supply of the initialization potential Vinit to the connection point Nb is stopped. That is, the first switching element T1 serves as a control unit that controls whether the initialization potential Vinit is supplied to the connection point Nb.

As shown in FIG. 2, the drain terminal of the second switching element T2 is connected to a connection point Na between the second electrode L2 of the storage capacitor C and the source terminal of the selecting transistor Ts1. In this case, the second switching element T2 is an n-channel-type thin film transistor whose source terminal is connected to the source terminal of the driving transistor Tdr and whose gate terminal is connected to the second control line 112, and serves as a switching element that switches an electrically conductive state and an electrically non-conductive state between the connection point Na and the source terminal of the driving transistor Tdr. That is, for a period when the second control signal S2 [i] becomes a high level, the second switching element T2 is turned on, so that the connection point Na (that is, the second electrode L2 of the storage capacitor C) is electrically connected to the source terminal of the driving transistor Tdr. In contrast, for a period when the second control signal S2 [i] becomes a low level, the second switching element T2 is turned off, so that the connection point Na is electrically insulated from the source terminal of the driving transistor Tdr.

In the meantime, when the material used for the semiconductor layer of the thin film transistor is amorphous silicon, it becomes difficult for the p-type TFT to be used. In the present embodiment, all of the switching elements (the driving transistor Tdr, the selecting transistor Ts1, the first switching element T1, and the second switching element T2), which form the pixel circuit P, correspond to n-channel-type thin film transistors. Therefore, the thin film transistor in which the amorphous silicon is used for the semiconductor layer can form the pixel circuit P. However, in each of the switching elements which form the pixel circuit P, various transistors may be used in which the semiconductor layer is formed of a material, such as polysilicon (in particular, low-temperature polysilicon) or the like.

Figure 3:
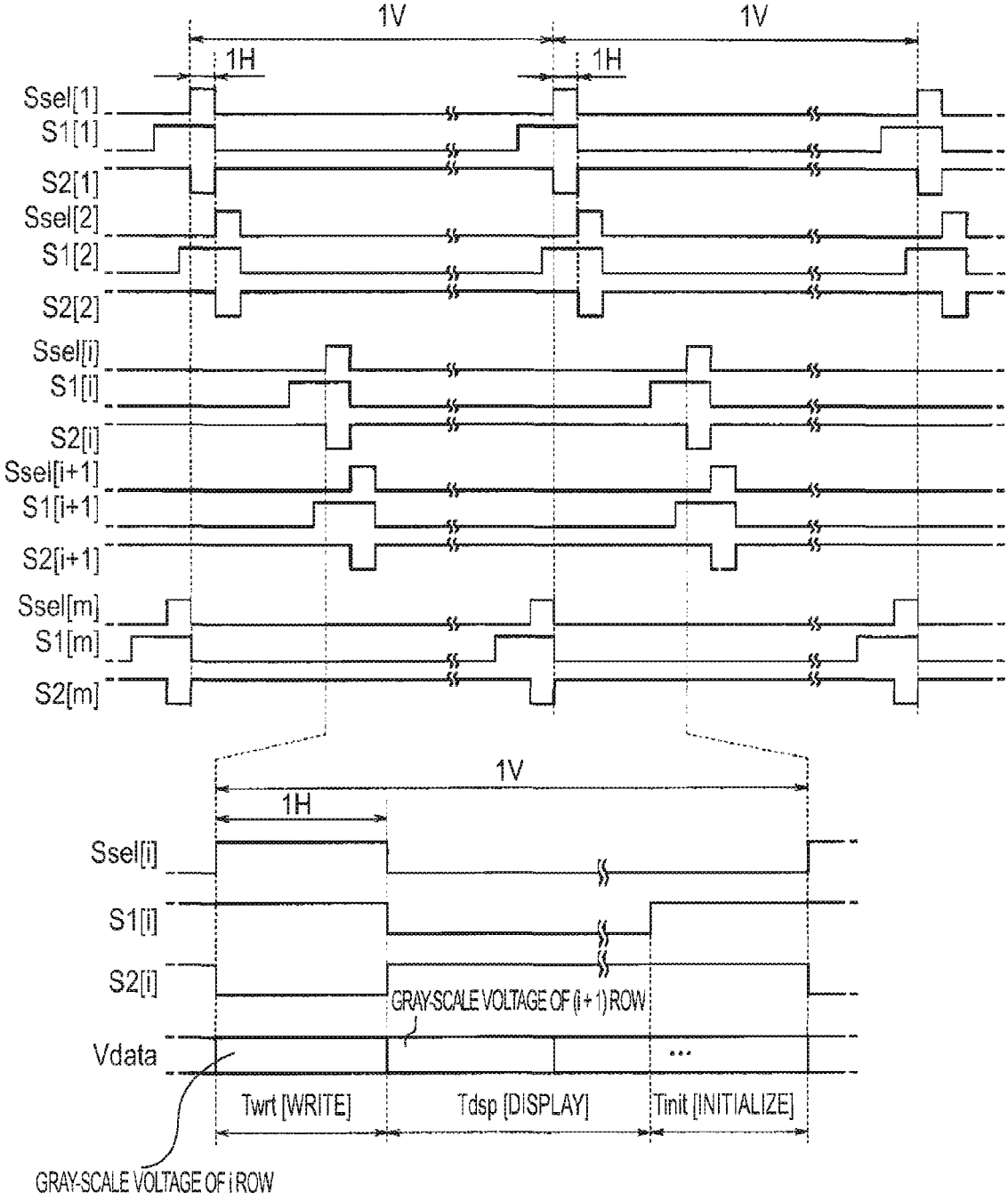
FIG. 3 is a timing chart illustrating a waveform of a signal supplied to the pixel circuit shown in FIG. 2.

Next, a specific waveform of each of the signals, which are generated by the scanning line driving circuit 21, will be described with reference to FIG. 3. As shown in FIG. 3, each of the scanning signals Ssel [1] to Ssel [m] becomes a high level sequentially for every horizontal scanning period (1H) That is, the scanning signal Ssel [i] becomes a high level for only the i-th horizontal scanning period of one vertical scanning period (1V), and becomes a low level for the other horizontal scanning periods. In addition, the shift of the scanning signal Ssel [i] to the high level means that the pixel circuits P of the i-th row are selected. As shown in FIG. 3, for a horizontal scanning period when the scanning signal Ssel [i] becomes a high level, the data potential Vdata corresponding to the gray-scale level of each of the pixel circuits P of the i-th row is supplied to the data line 13. The data potential Vdata is supplied to the second electrode L2 of the storage capacitor C through the selecting transistor Ts1 which has been turned on by the scanning line Ssel [1] of the high level. Hereinafter, a period when each of the scanning signals Ssel [1] to Ssel [m] becomes a high level (that is, a horizontal scanning period) is represented as a 'writing period Twrt'.

For a writing period Twrt corresponding to each of the first control signals S1 [1] to S1 [m] and a period Tinit (hereinafter, referred to as an 'initialization period') right before the writing period Twrt, it becomes a high level. That is, the first control signal S1 [i] becomes a high level for a writing period Twrt when the pixel circuits P of the i-th row are selected (that is, a horizontal scanning period when the scanning signal Ssel [i] becomes a high level) and the initialization period Tinit right before the writing period, and becomes a low level for the other periods.

Each of the second control signals S2 [1] to S2 [m] corresponds to a signal which has a waveform in which a logical level of each of the scanning signals Ssel [1] to Ssel [m] is inverted. That is, the second control signal S2 [i] becomes a high level from a final point of the writing period Twrt when the scanning signal Ssel [i] becomes a high level to a starting point of a next writing period Twrt (that is, a time when the scanning signal Ssel [i] shifts from a low level to a high level), and becomes a low level for the other periods (that is, the i-th writing period Twrt). Hereinafter, a period when each of the second control signals S2 [1] to S2 [*m*] becomes a high level is represented as a 'display period Tdsp'.

Next, the specific operation of the pixel circuit P will be described with reference to FIG. 4. Hereinafter, the operation of the pixel circuits P of the j-th column, which belongs to the i-th row, will be described in a state in which it is divided into the initialization period Tinit, the writing period Twrt, and the display period Tdsp.

Initialization Period Tinit

Figure 4A:
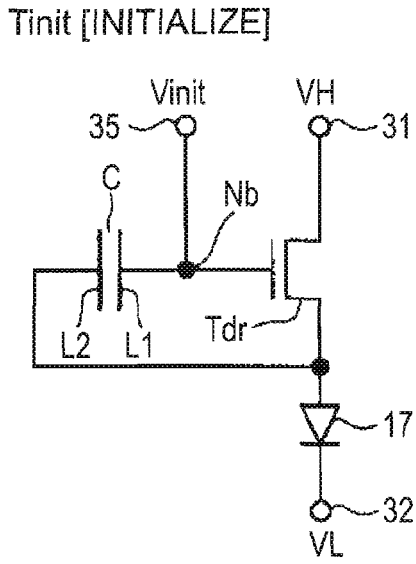
FIG. 4 is a circuit diagram illustrating the operation of the pixel circuit shown in FIG. 2.

As shown in FIG. 3, for the initialization period Tinit, the scanning signal Ssel [i] becomes a low level, and each of the first control signal S1 [i] and the second control signal S2 [i] becomes a high level. At this time, the pixel circuit P is shown in an equivalent manner in a circuit diagram of FIG. 4A. As shown in FIG. 4A, for the initialization period Tinit, the connection point Nb and the initialization wiring line 35 are electrically connected to each other through the first switching element T1 which has been turned on by the first control signal S1 [i] of a high level. Accordingly, the first electrode L1 of the storage capacitor C and the gate terminal of the driving transistor Tdr are supplied with the initialization potential Vinit. In addition, for the initialization period Tinit, the second electrode L2 of the storage capacitor C and the source terminal of the driving transistor Tdr are electrically connected to each other through the second switching element T2 which has been turned on by the second control signal S2 [i] of a high level.

In this case, in the state shown in FIG. 4A, the initialization potential Vinit is set to a level which allows the driving transistor Tdr to be turned off. Accordingly, for the initialization period Tinit, the supply of the current to the light-emitting element 17 is stopped such that the light-emitting element 17 does not emit the light. That is, in the present embodiment, since the light-emitting element 17 is selectively driven for only the display period Tdsp, a predetermined image can be displayed with a high quality. In addition, for the initialization period Tinit, a consumed power can be reduced, as compared with a structure in which the current flows into the light-emitting element 17.

Writing Period Twrt

Figure 4B:
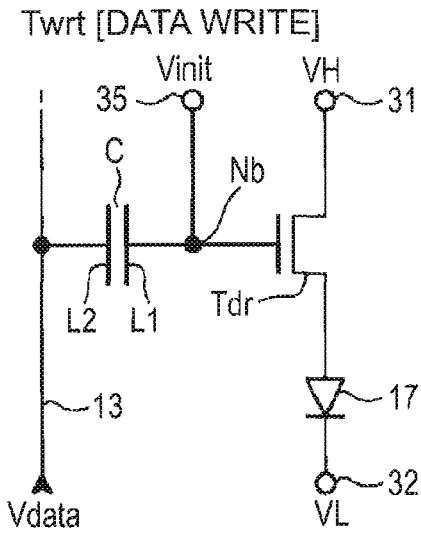

As shown in FIG. 3, for the writing period Twrt, each of the scanning signal Ssel [i] and the first control signal S1 [i] becomes a high level, and the second control signal S2 [i] becomes a low level. At this time, the pixel circuit P is shown in an equivalent manner in a circuit diagram of FIG. 4B. As shown in FIG. 4B, similar to the initialization period Tinit, for the writing period Twrt, the first electrode L1 of the storage capacitor C and the gate terminal of the driving transistor Tdr are supplied with the initialization potential Vinit. In addition, for the writing period Twrt, the second electrode L2 of the storage capacitor C and the data line 13 are electrically connected to each other through the selecting transistor Ts1 which has been turned on by the scanning signal Ssel [i] of a high level. Accordingly, at this time, the data potential Vdata of the data line 13 of the j-th column (that is, potential according to the gray-scale level of the pixel circuit P of the j-th column which belongs to the i-th row) is supplied to the second electrode L2 of the storage capacitor C.

Display Period Tdsp

Figure 4C:
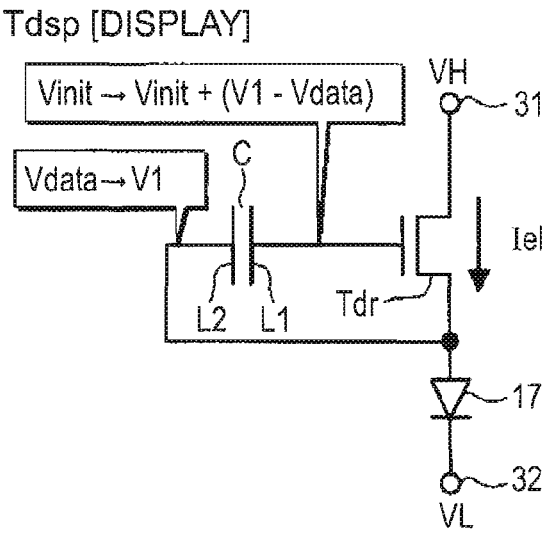

As shown in FIG. 3, for the display period Tdsp, each of the scanning signal Ssel [i] and the first control signal S1 [i] becomes a low level, and the second control signal S2 [i] becomes a high level. At this time, the pixel circuit P is shown in an equivalent manner in a circuit diagram of FIG. 4C. As shown in FIG. 4C, the connection destination of the second electrode L2 of the storage capacitor C changes from the data line 13 to the source terminal of the driving transistor Tdr, so that the potential of the second electrode L2 changes from the data potential Vdata supplied for the writing period Twrt right before the display period Tdsp to the potential V1. This potential V1 is a potential that is determined in accordance with the characteristic of the light-emitting element 17. In addition, as the potential of the second electrode L2 varies, the potential of the connection point Nb (the first electrode L1 of the storage capacitor C and the gate terminal of the driving transistor Tdr) also varies. If it is considered that an amount of an electric charge in the connection point Nb does not vary for the writing period Twrt and the display period Tdsp, the potential of the connection point Nb after the variation becomes 'Vinit+(V1−Vdata)'. This potential is supplied to the gate terminal of the driving transistor Tdr, so that the current Ie1 according to the corresponding potential flows through the ground line 32 from the power supply line 31 via the driving transistor Tdr and the light-emitting element 17. Accordingly, the light-emitting element 17 emits light with luminance according to the data potential Vdata.

The current Ie1, which flows through the light-emitting element 17 for the display period Tdsp, has been examined. A gain coefficient of the driving transistor Tdr is set to 'β', the voltage between the gate terminal and the source terminal of the driving transistor Tdr is set to 'Vgs', and a threshold voltage of the driving transistor Tdr is set to 'Vth'. In this case, the current Ie1 when the driving transistor Tdr operates in a saturation region is represented by the following Equation (1).

$$Ie1=(1/2)\beta(Vgs-Vth)^2 \quad \text{[Equation 1]}$$

As described above, for the display period Tdsp, the potential of the connection point Na (that is, potential of the source terminal of the driving transistor Tdr) is 'V1', and the potential of the connection point Nb (that is, potential of the gate terminal of the driving transistor Tdr) is 'Vinit+(V1−Vdata)'. In Equation (1) the voltage Vgs corresponds to the difference between the potential of the connection point Na and the potential of the connection point Nb (Vgs=Vinit+(V1−Vdata)−V1)'. Equation (1) is changed to the following Equation (2).

$$Ie1=(1/2)\beta[\{Vinit+(V1-V\text{data})-V1\}-Vth]^2=(1/2)\beta(Vinit-Vdata-Vth)^2 \quad \text{[Equation 2]}$$

As apprehended from Equation (2), the current Ie1 flowing through the light-emitting element 17 does not depend on the potential VH or the potential VL. Accordingly, even though the potential VH supplied to each pixel circuit P is different for each pixel circuit P due to the voltage drop in the power supply line 31 if a common gray-scale level is instructed to the plurality of pixel circuits P1 the currents Ie1, which are supplied to the light-emitting elements 17 of the pixel circuits P, are equal to each other. Accordingly, in the present embodiment, it is possible to effectively suppress the display irregularities due to a variation of the potential VH or the potential VL.

In addition, as represented in Equation (2), the current Ie1 depends on the initialization potential Vinit. However, the initialization wiring line 35, which are connected to the first electrode L1 of the storage capacitor C and the gate terminal of the driving transistor Tdr, is not supplied with a current, so that the voltage drop does not occur in the initialization wiring line 35. That is, the initialization potential Vinit; which is supplied to the respective pixel circuits P, becomes substantially the same potential. Accordingly, even though the current Ie1 depends on the initialization potential Vinit, the variation of the current Ie1 can be suppressed, as compared with a case in which a structure according to the related art in which the current Ie1 depends on the potential VH of the power supply line 31 through which a large amount of current flows according to the supply of the current Ie1 to the light-emitting element 17.

In addition, in the present embodiment, since all of the switching elements of the pixel circuits P are n-channel-type elements, it is possible to form the pixel circuit P by the thin film transistor in which the amorphous silicon is used in the semiconductor layer (hereinafter, referred to as 'a-TFT'). In the meantime, it has been known that if the same polarity potential is normally and continuously supplied to the gate terminal in the a-TFT, the threshold voltage varies. In the present embodiment, when each switching element of the pixel circuit P is composed of the a-TFT, the threshold voltage Vth may shift by the supply of the initialization potential Vinit to the gate terminal of the driving transistor Tdr. However, the initialization potential Vinit is set to a very low level, and it is thus possible to effectively prevent the threshold voltage Vth of the driving transistor Tdr from shifting.

Second Embodiment

Next, a second embodiment of the invention will be described.

In the first embodiment, each of the scanning signal Ssel [i], the first control signal S1[i], and the second control signal S2 [i] is constructed as an individual signal, but at least one of these signals may serve as another signal. In the pixel circuit P in the second embodiment, the scanning signal Ssel [i] serves as the first control signal S1[i] (that is, the first control signal S1 [i] serves as the scanning signal Ssel [i]). In addition, constituent elements of the other embodiments (which will be described in detail below), which are the same as those of the first embodiment, are denoted by the same reference numerals, and the description thereof will be properly omitted.

Figure 5:
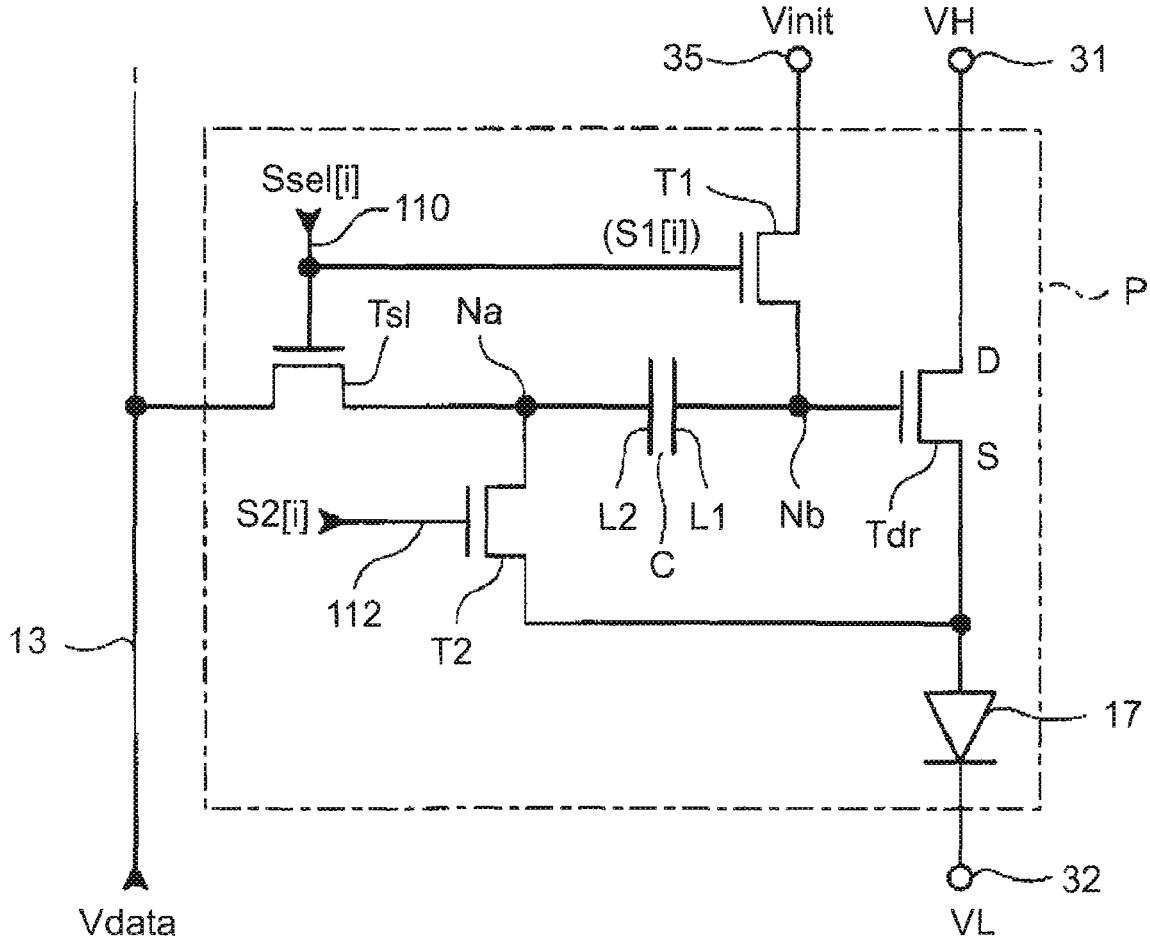
FIG. 5 is a circuit diagram illustrating a structure of a pixel circuit according to a second embodiment.

FIG. 5 is a circuit diagram illustrating a structure of a pixel circuit P according to the present embodiment. As shown in FIG. 5, in the pixel circuit P according to the present embodiment, the gate terminal of the first switching element T1 and the gate terminal of the selecting transistor Ts1 are connected to the scanning line 110. Accordingly, the scanning signal Ssel [i], which is output from the scanning line driving circuit 21, is used to control the selecting transistor Ts1 and the first switching element T1.

Figure 6:
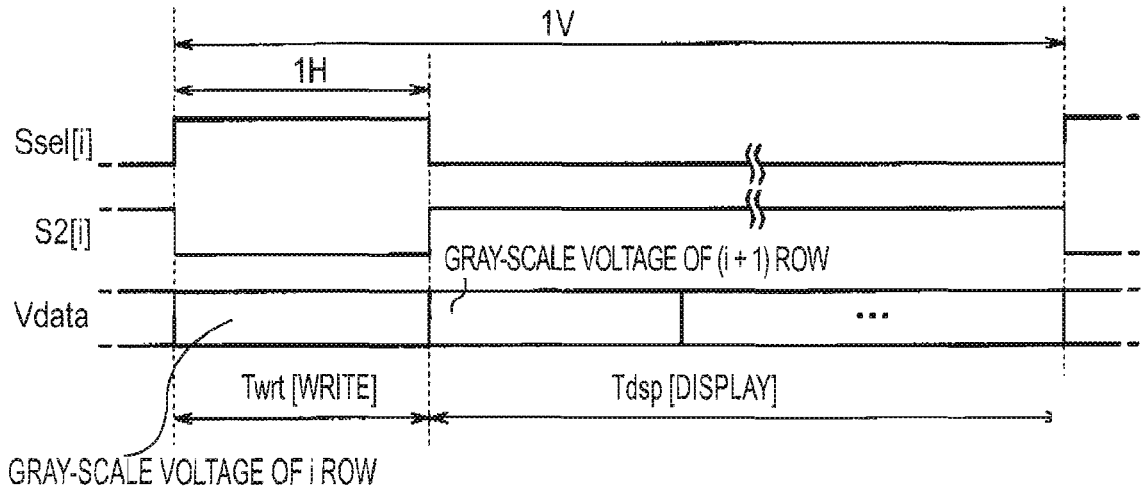
FIG. 6 is a timing chart illustrating a waveform of a signal supplied to the pixel circuit shown in FIG. 5.
Figure 7A:
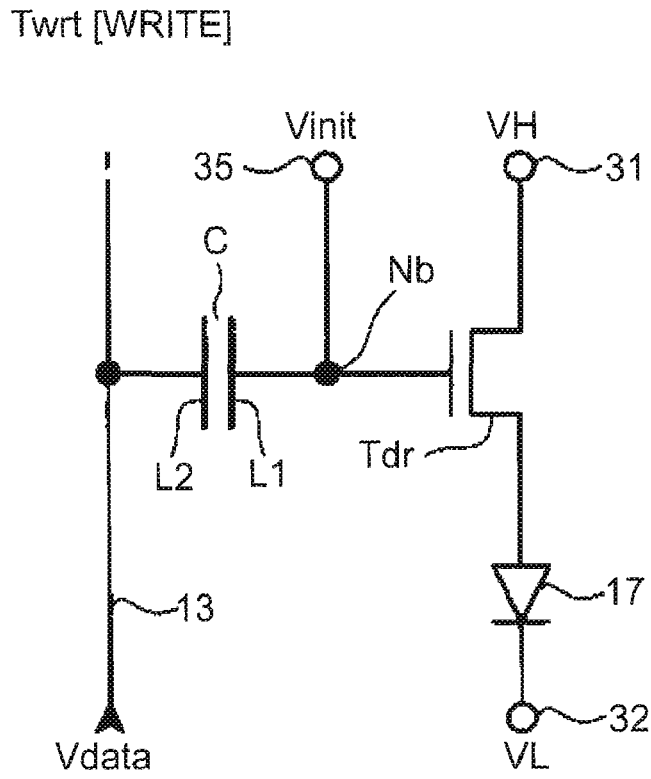
FIG. 7 is a circuit diagram illustrating the operation of the pixel circuit shown in FIG. 5.
Figure 7B:
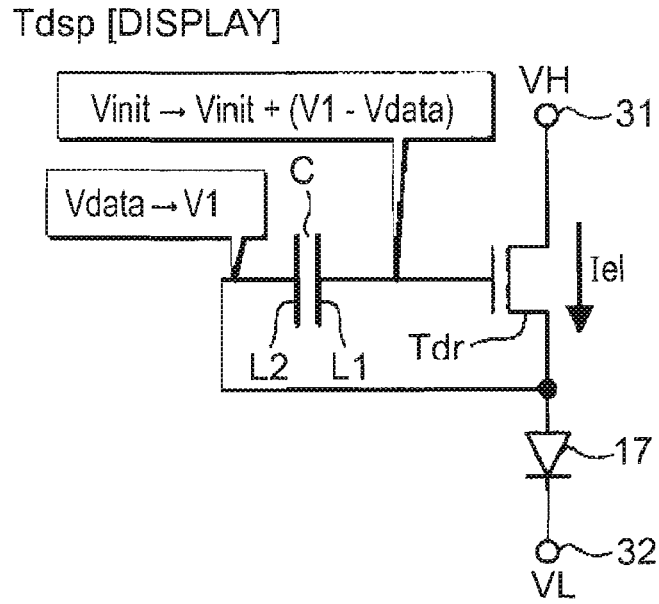

As shown in FIG. 6, for the writing period Twrt when the scanning signal Ssel [i] becomes a high level, as shown in FIG. 7A, the second electrode L2 of the storage capacitor C and the data line 13 are electrically connected to each other through the selecting transistor Ts1, and the first electrode L1 of the storage capacitor C and the initialization wiring line 35 are electrically connected to each other through the first switching element T1. In the meantime, as shown in FIG. 7B, an equivalent circuit of the pixel circuit P for the display period Tdsp is the same as the first embodiment (FIG. 4C). As shown in FIG. 6, in the present embodiment, the initialization period Tinit, which is separated from the writing period Twrt, is not set.

In this case, since the current Ie1, which is supplied to the light-emitting element 17, becomes the current value represented by Equation (2), the same effect as the first embodiment can be obtained. In addition, in the present embodiment, since the scanning signal Ssel [i] also serves as the first control signal S1 [i], the structure can be simplified, as compared with a case in which each of the selecting transistor Ts1 and the first switching element T1 is controlled by an individual signal.

Third Embodiment

Next, a third embodiment of the invention will be described. In the first embodiment, separately from the scanning signal Ssel[i], the first control signal S1[i], and the second control signal S2[i], the initialization potential Vinit is generated by the power supply circuit 28, but the signal, which is generated by the scanning line driving circuit 21, may be used as the initialization potential Vinit. In the present embodiment, the pixel circuit P may be constructed such that the second control signal S2[i] is also used as the initialization potential Vinit.

Figure 8:
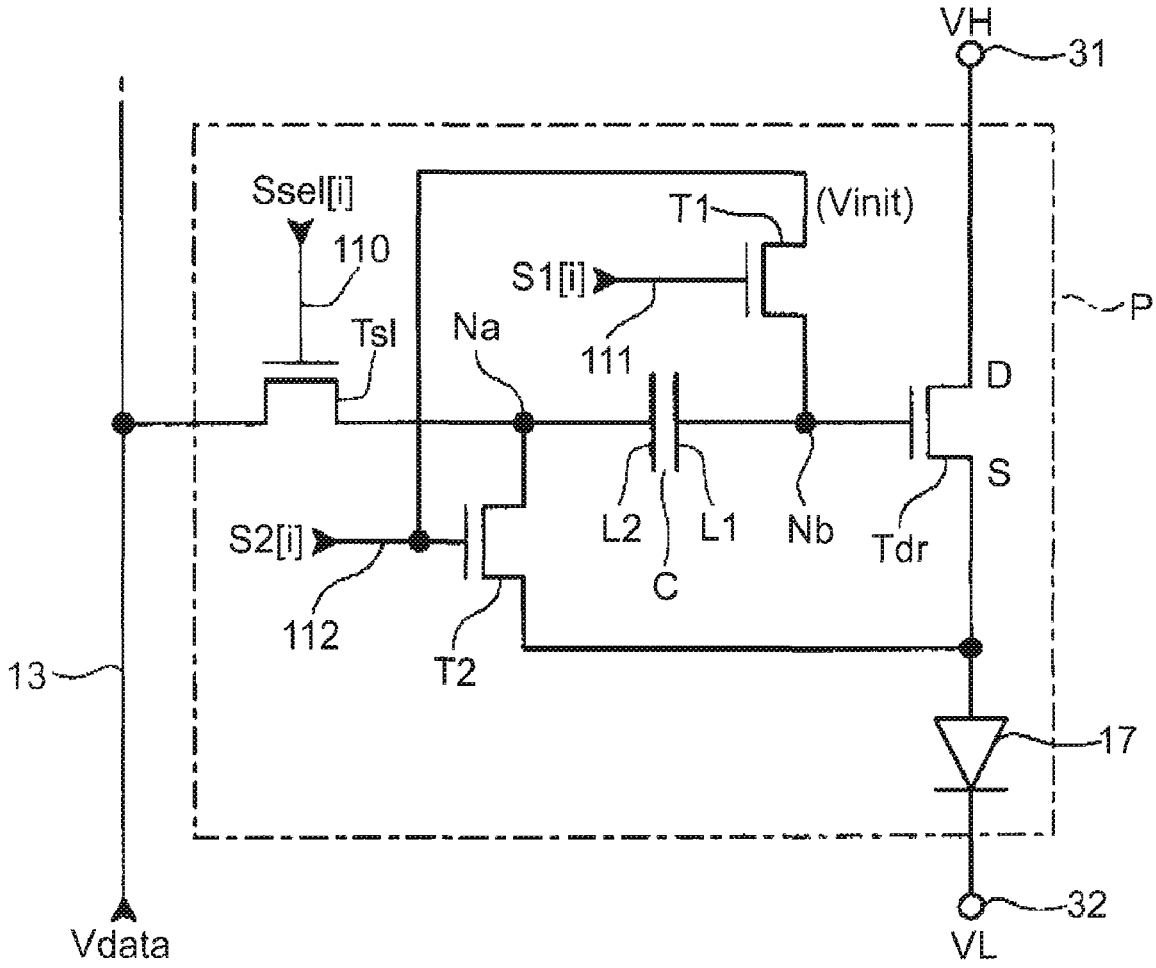
FIG. 8 is a circuit diagram illustrating a structure of a pixel circuit according to a third embodiment of the invention.

FIG. 8 is a circuit diagram illustrating a structure of the pixel circuit P according to the present embodiment. As shown in FIG. 8, in the present embodiment, the drain terminal of the first switching element T1 and the gate terminal of the second switching element T2 are connected to the second control line 112. That is, the second control signal S2[i], which is output from the scanning line driving circuit 21, is used for control of a state of the second switching transistor T2, and supplied to the connection point Nb as the initialization potential Vinit.

Figure 9:
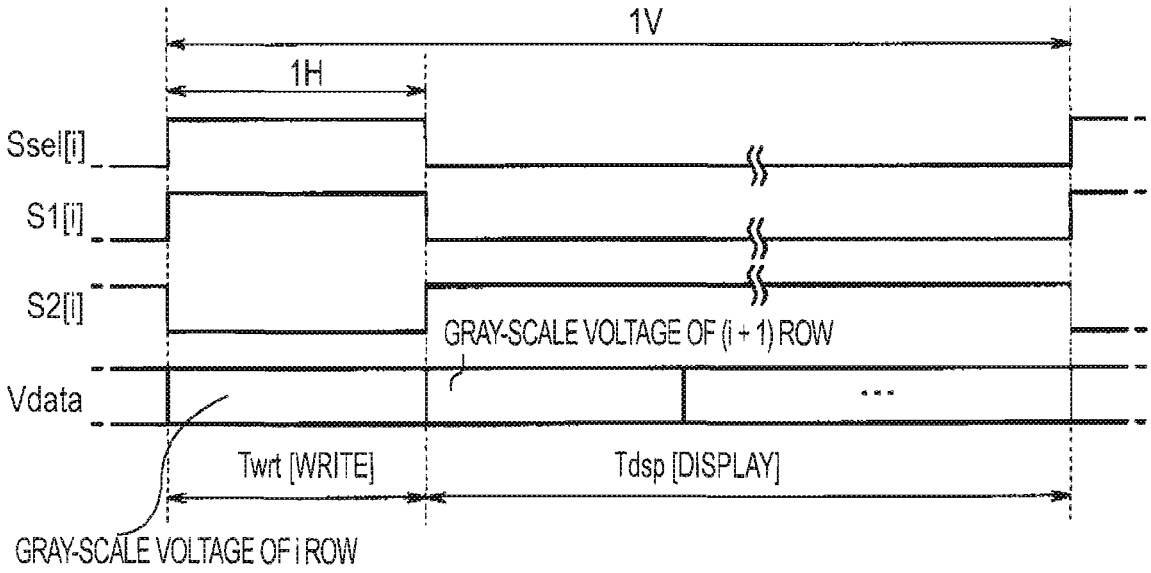
FIG. 9 is a timing chart illustrating a waveform of a signal supplied to the pixel circuit shown in FIG. 8.
Figure 10A:
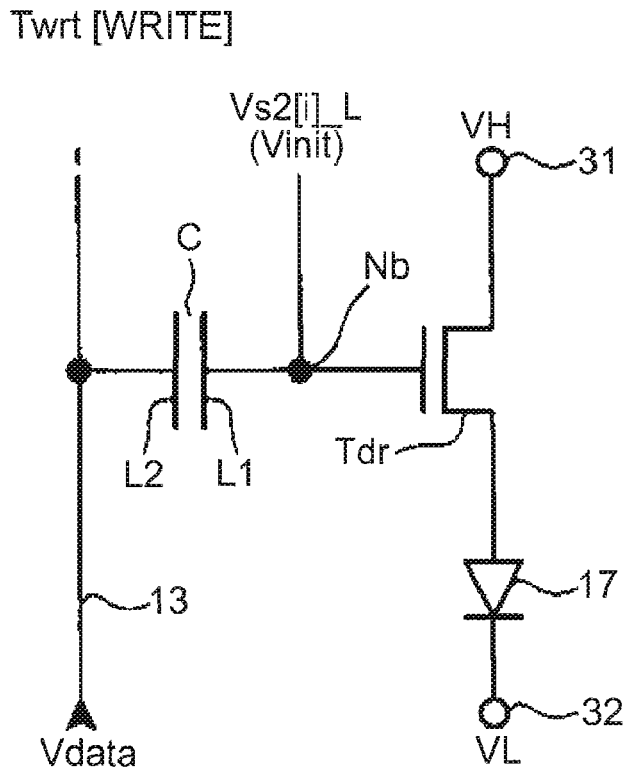
FIG. 10 is a circuit diagram illustrating the operation of the pixel circuit shown in FIG. 8.
Figure 10B:
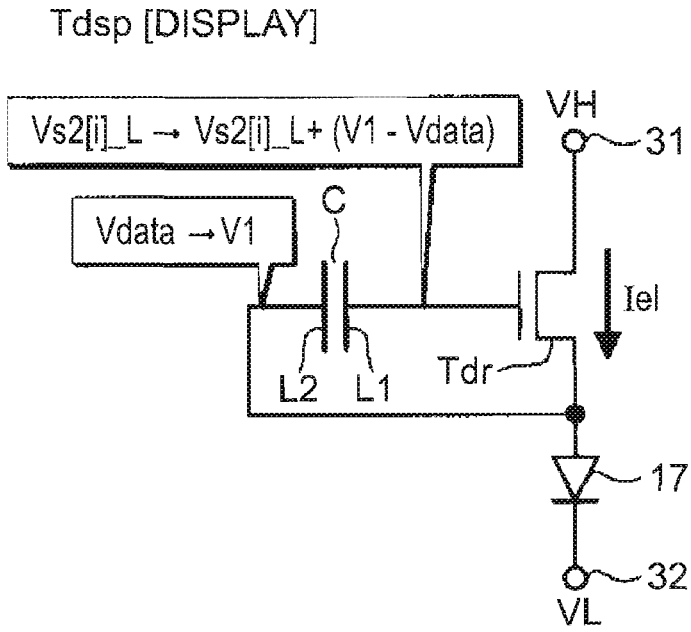

As shown in FIG. 9, in the present embodiment, the second control signal S2[i] has the same waveform as the scanning signal Ssel[i]. Accordingly, similar to the second embodiment, the initialization period Tinit, which is separated from the writing period Twrt, is not set. As shown in FIGS. 9 and 10A, for the writing period Twrt, the potential VS2 [i]_L of the second control signal S2[i] of the low level is supplied to the connection point Nb through the first switching element T1. Accordingly, as shown in FIG. 10B, since the potential of the connection point Nb for the display period Tdsp becomes 'VS2[i]_L+(V1−Vdata)', the current Ie1, which flows through the light-emitting element 17 for the display period Tdsp, is represented by Equation (2a)

$$Ie1=(1/2)\beta(VS2[i]_L-V\text{data}-Vth)^2 \quad \text{[Equation 2a]}$$

In the present embodiment, since the current Ie1 does not depend on the potential VH or the potential VL, the same effect as the first embodiment can be obtained. In addition, in the present embodiment, the structure can be simplified, as compared with a case in which the initialization potential Vinit is generated separately from the other signals.

Fourth Embodiment

Next, a fourth embodiment of the invention will be described. In the third embodiment, the signal (the second control signal S2[i]), which is supplied to the respective pixel circuits P, also serves as the initialization potential Vinit in the corresponding pixel circuit P, but the signal supplied to the respective pixel circuits P may serve as the initialization potential Vinit of another pixel circuit P. In the present embodiment, the scanning signal Ssel[i−1], which is supplied to each of the pixel circuits P of the (i−1)-th row, serves as the initialization potential Vinit in each of the pixel circuits P of the i-th row that is adjacent to the corresponding pixel circuit P in a plus Y direction.

Figure 11:
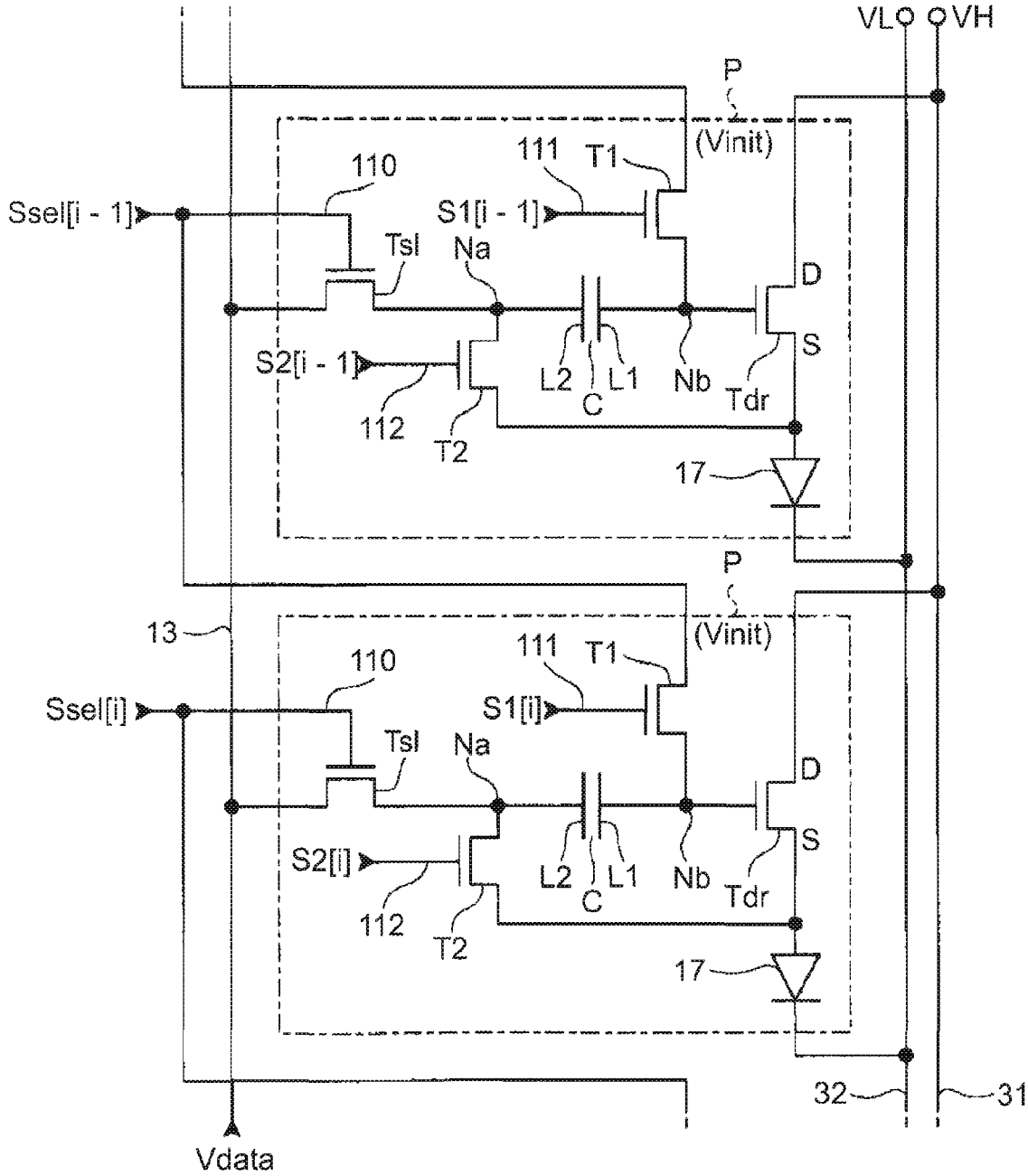
FIG. 11 is a circuit diagram illustrating a structure of a pixel circuit according to a fourth embodiment of the invention.

FIG. 11 is a circuit diagram illustrating a structure of the pixel circuit P according to the present embodiment. In FIG. 11, the pixel circuit P of the j-th column, which belongs to the (i−1)-th row, and the pixel circuit P of the same column, which belongs to the i-th row, are shown. As shown in FIG. 11, in the pixel circuit P which belongs to the i-th row, the drain terminal of the first switching element T1 is connected to the scanning line 110 of the (i−1)-th row. That is, the scanning signal Ssel [i−1] is supplied to the pixel circuit P of the (i−1)-th row, and supplied to the pixel circuit P of the i-th row as the initialization potential Vinit.

Figure 12A:
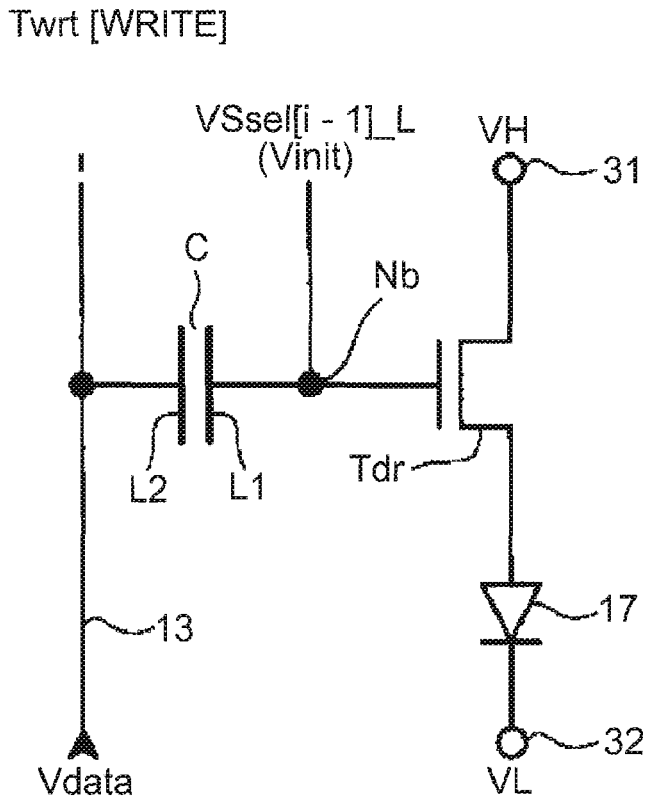
FIG. 12 is a circuit diagram illustrating the operation of the pixel circuit shown in FIG. 11.
Figure 12B:
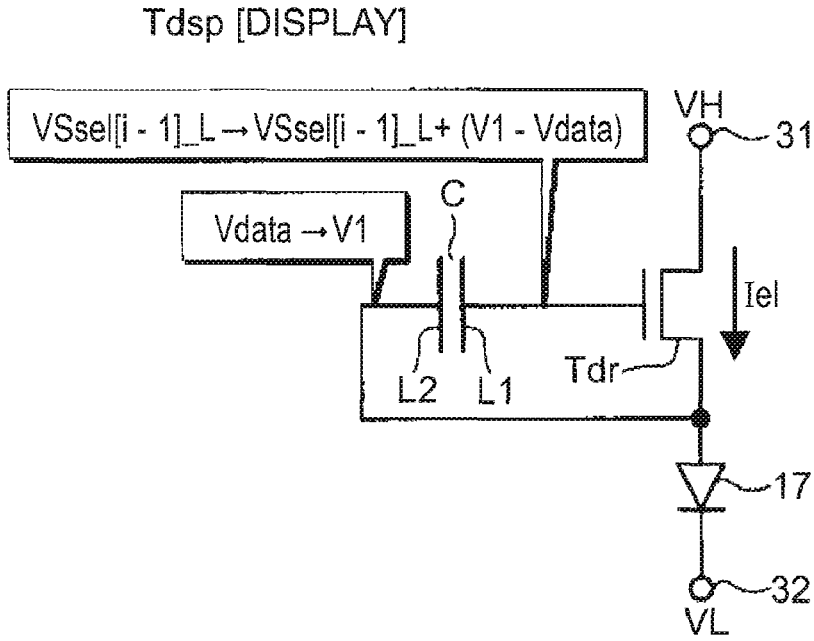

Each of the signals in the present embodiment has the same waveform as the third embodiment (FIG. 9). As shown in FIG. 12A, for the writing period Twrt when the scanning signal Ssel[i] becomes a high level, the potential VSsel[i−1]_L of the scanning signal Ssel[i−1] of the low level is supplied to the connection point Nb of the pixel circuit P of the i-th row as the initialization potential Vinit. Accordingly, as shown in FIG. 12B, since the potential of the connection point Nb of the pixel circuit P of the i-th row for the display period Tdsp becomes 'VSsel[i−1]_L+(V1−Vdata)', the current Ie1, which flows through the light-emitting element 17 for the display period Tdsp, is represented by Equation (2b).

$$Ie1=(1/2)\beta(VSsel[i-1]_L-V\text{data}-Vth)^2 \quad \text{[Equation 2b]}$$

In the present embodiment, since the current Ie1 does not depend on the potential VH or the potential VL, the same effect as the first embodiment can be obtained. In addition, in the present embodiment, similar to the third embodiment, the structure can be simplified, as compared with a case in which the initialization potential Vinit is generated separately from the other signals.

In addition, in the present embodiment, the scanning signal Ssel[i], which is supplied to each pixel electrode P, also serves as the initialization potential Vinit of the pixel electrode P that is adjacent to the corresponding pixel electrode P in a Y direction, but the supply source of the scanning signal Ssel[i], which also serves as the initialization potential Vinit, may arbitrarily change. For example, the scanning signal, which is supplied to the scanning line 110 (for example, the scanning line 110 of the (i−2)-th row) other than the (i−1)-th row, may be used as the initialization potential Vinit in the pixel circuit P of the i-th row.

Fifth Embodiment

Next, a fifth embodiment of the invention will be described. In the above-mentioned embodiments, all of the switching elements, which form the pixel circuit P, correspond to n-channel-type elements. However, a channel type of each of the switching elements may be properly changed. In the present embodiment, the p-channel-type transistor is used as the driving transistor Tdr.

Figure 13:
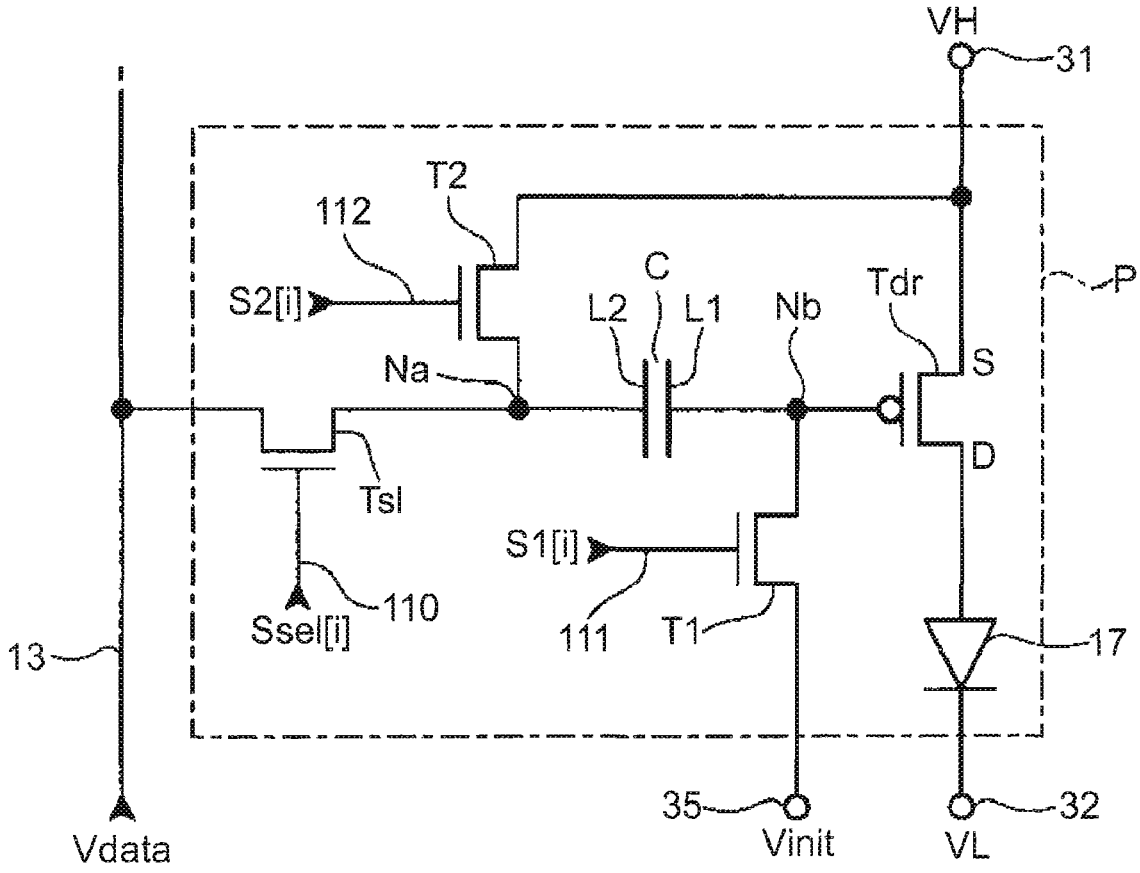
FIG. 13 is a circuit diagram illustrating a structure of a pixel circuit according to a fifth embodiment of the invention.

FIG. 13 is a circuit diagram illustrating a structure of the pixel circuit P according to the present embodiment. As shown in FIG. 13, the driving transistor Tdr according to the present embodiment is a p-channel-type thin film transistor whose source terminal is connected to the power supply line 31 and whose drain terminal is connected to the anode of the light-emitting element 17. In the second switching element T2, the drain terminal is connected to the source terminal of the driving transistor Tdr and the power supply line 31, and the source terminal is connected to the connection point Na. In addition, a waveform of each of the signals, which are supplied to the pixel circuit P, is the same as that of the first embodiment (FIG. 3).

Figure 14A:
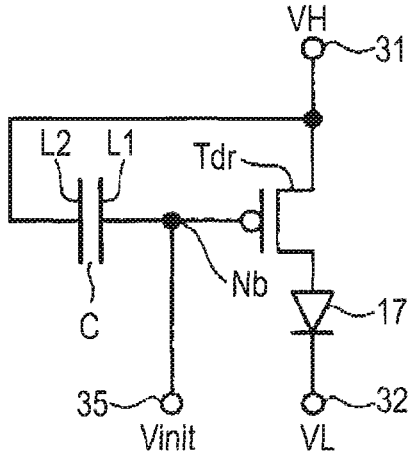
FIG. 14 is a circuit diagram illustrating the operation of the pixel circuit shown in FIG. 13.
Figure 14B:
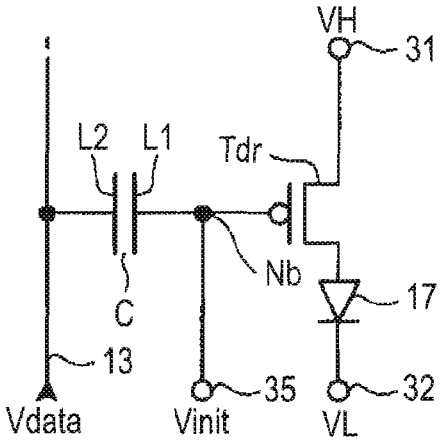
Figure 14C:
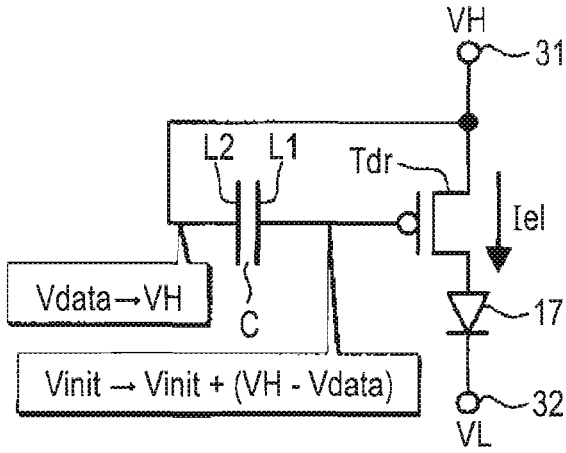

As shown in FIG. 14A, for the initialization period Tinit, the second electrode L2 of the storage capacitor C is electrically connected to the source terminal of the driving transistor Tdr. Accordingly, the second electrode L2 is supplied with the potential VH from the power supply line 31. As shown in FIG. 14B, for the writing period Twrt, the second electrode T2 of the storage capacitor C is supplied with the data potential Vdata, and the first electrode L1 is supplied with the initialization potential Vinit. In the meantime, as shown in FIG. 14C, for the display period Tdsp subsequent to the writing period Twrt, the second switching element T2 shifts from an off state to an on state, so that the potential of the second electrode L2 of the storage capacitor C varies from the potential Vdata to the potential VH. As such, as the potential varies, the potential of the first electrode L1 of the storage capacitor C varies from the potential Vinit supplied for the writing period Twrt to the potential 'Vinit+(VH−Vdata)'. In this case, the voltage Vgs between the gate terminal and the source terminal of the driving transistor Tdr for the display period Tdsp corresponds to the difference (Vgs=VH−{Vinit+(VH−Vdata)}) between the potential of the first electrode L1 and the potential of the second electrode L2 in the storage capacitor C. Therefore, if the driving transistor Tdr operates in a saturation region, the current Ie1, which flows through the light-emitting element 17 for the display period Tdsp, is represented by the following Equation (2c).

$$Ie1=(½)\beta(Vgs-Vth)^2=(1/2)\beta[VH-\{Vinit+(VH-Vdata)\}-Vth)^2=(½)\beta(Vdata-Vinit-Vth)^2 \quad \text{[Equation 2c]}$$

As such, in the present embodiment, since the current Ie1 does not depend on the potential VH or the potential VL, the same effect as the first embodiment can be obtained. In addition, in the present embodiment, since the driving transistor Tdr is a o-channel type, it is possible to reduce the potential which should be applied to the gate terminal of the driving transistor Tdr, as compared with the first to fourth embodiments in which the driving transistor Tdr is an n-channel type.

In the present embodiment, as in the second embodiment, at least one of the signals, which are supplied to the pixel circuit P, may also serve as another signal, or as in the third embodiment or the fourth embodiment, any signal may also serve as the initialization potential Vinit. Specific aspects are as follows.

First Aspect

Figure 15:
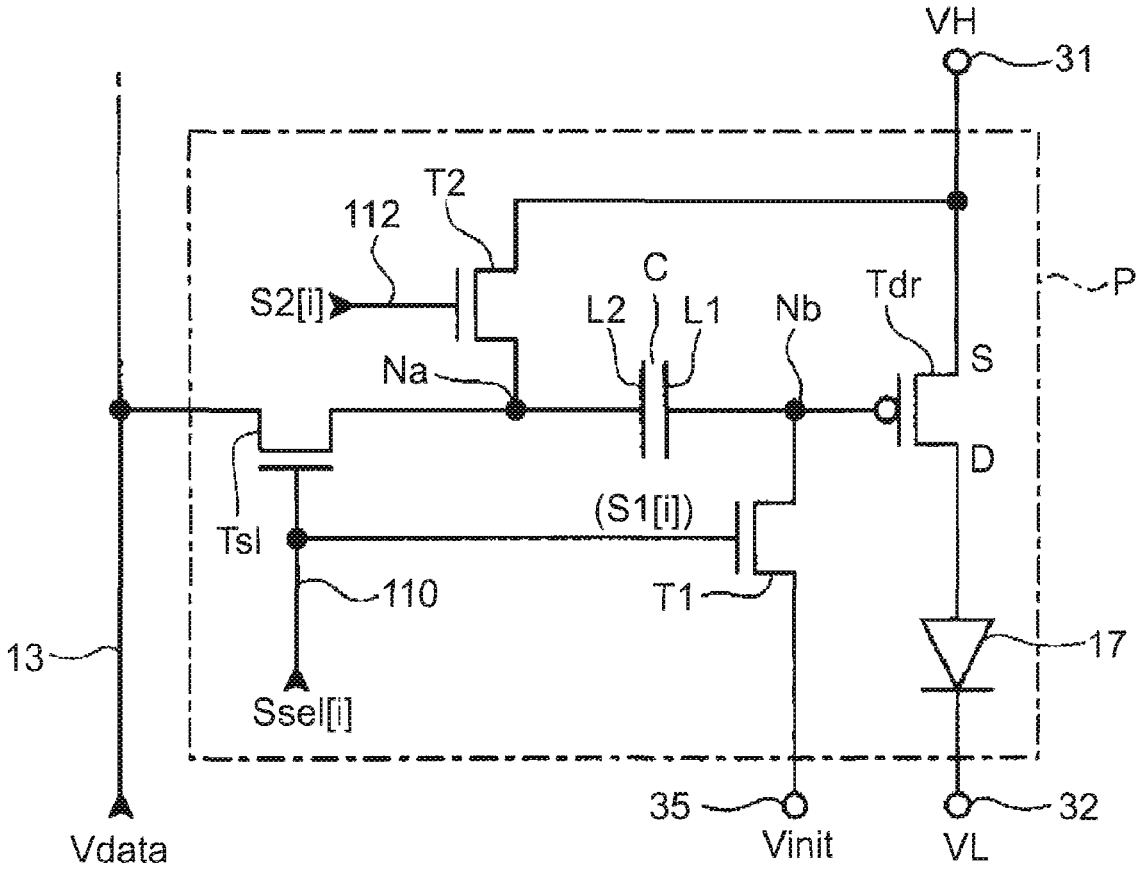
FIG. 15 is a circuit diagram illustrating a structure of a pixel circuit according to a first aspect.

As shown in FIG. 15, the gate terminal of the first switching element T1 and the gate terminal of the selecting transistor Ts1 may be connected to the scanning line 110, and thus the scanning signal Ssel [i] may also serve as the first control signal S1 [i]. In this configuration, a waveform of each signal is the same as that of the second embodiment (FIG. 6).

As shown in FIG. 14B, for the writing period Twrt, the first electrode L1 is supplied with the initialization potential Vinit, and the second electrode L2 is supplied with the data potential Vdata. In the meantime, as shown in FIG. 14C, for the display period Tdsp, the potential of the second electrode L2 varies to the potential VH, and the potential of the first electrode L1 varies to the potential 'Vinit+(VH−Vdata)'. Accordingly, even in the present aspect, since the current Ie1 does not depend on the potential VH or the potential VL, the same effect as the first embodiment can be obtained. In addition, according to the present aspect, since the selecting transistor Ts1 and the first switching element T1 are controlled by the common signal (scanning signal Ssel [i]), the structure can be simplified, as compared with a case in which each of the selecting transistor Ts1 and the first switching element T1 is controlled by an individual signal.

Second Aspect

Figure 16:
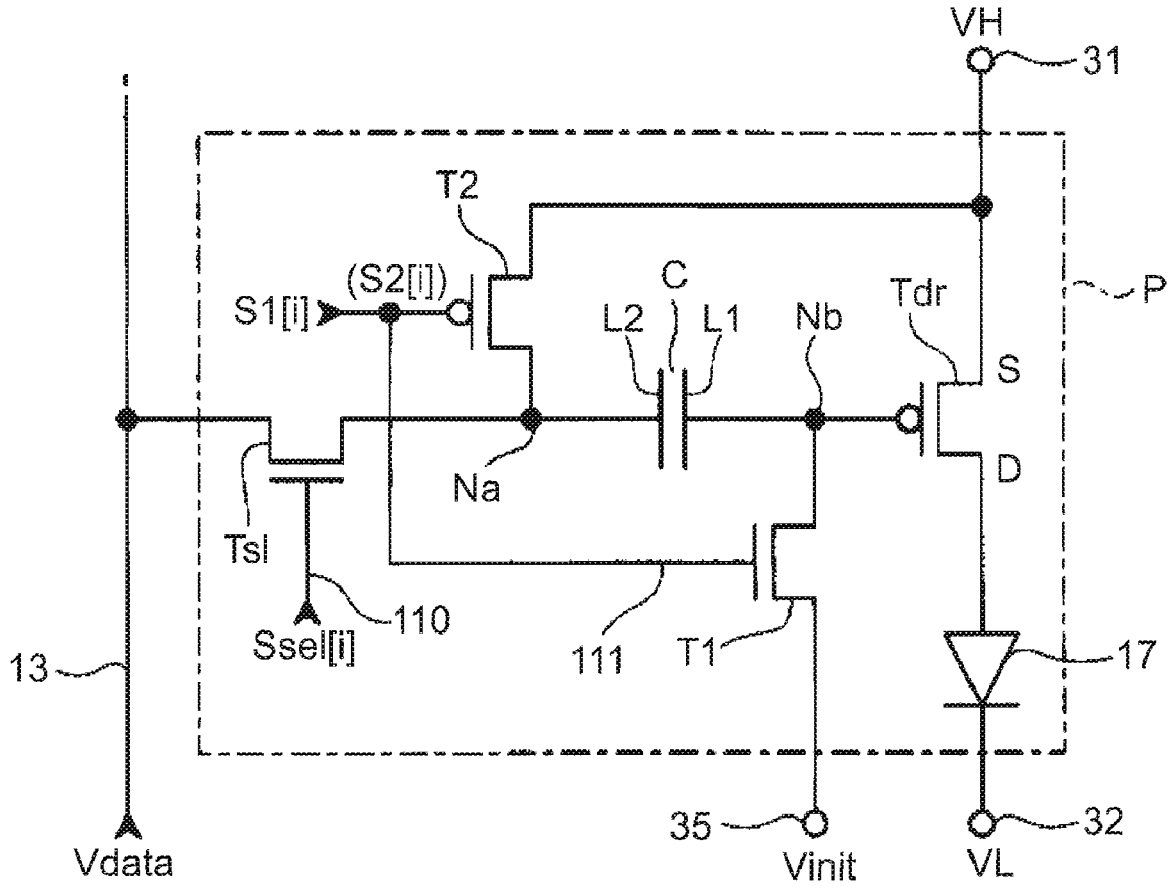
FIG. 16 is a circuit diagram illustrating a structure of a pixel circuit according to a second aspect.

As shown in FIG. 16, the gate terminal of the second switching element T2 and the gate terminal of the first switching element T1 may be connected to the first control line 111, and thus the first control signal S1[i] may also serve as the second control signal S2[i]. However, in this configuration, the second switching element T2 is a p-channel-type transistor.

Figure 17:
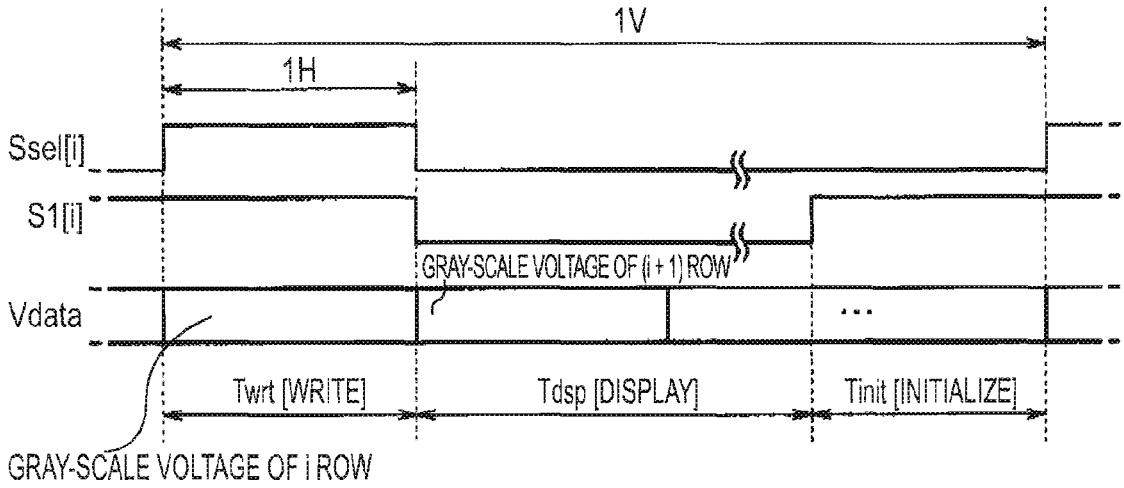
FIG. 17 is a timing chart illustrating a waveform of each signal supplied to the pixel circuit shown in FIG.
Figure 18A:
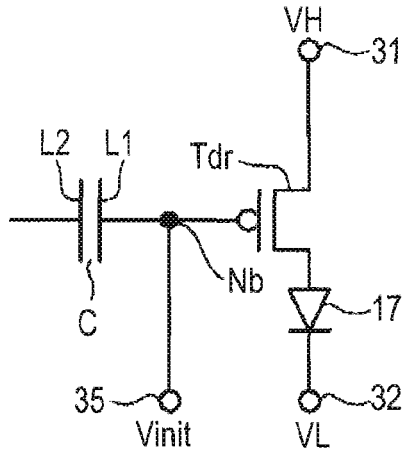
FIG. 18 is a circuit diagram illustrating the operation of the pixel circuit shown in FIG. 16.
Figure 18B:
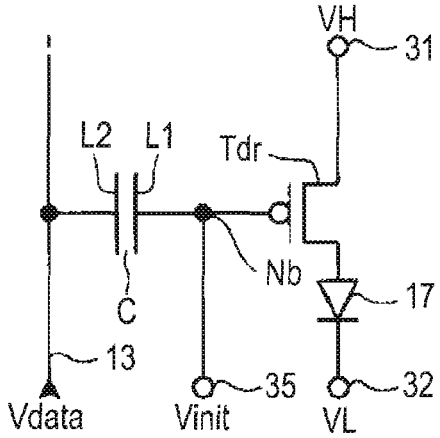
Figure 18C:
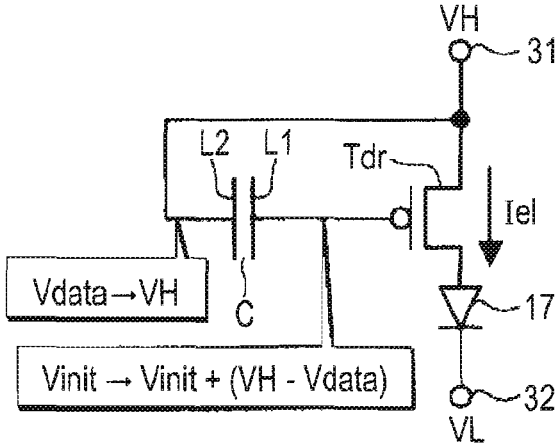

As shown in FIG. 17, according to the present aspect, for the initialization period Tinit and the writing period Twrt, the first control signal S1[i], which becomes a high level, is supplied to the first switching element T1 and the second switching element T2. Accordingly, as shown in FIG. 18A, for the initialization period Tinit, the second switching element T2 is turned off, so that the second electrode L2 of the storage capacitor C is not electrically connected to the data line 13 and the drain terminal of the driving transistor Tdr. In the meantime, as shown in FIGS. 18B and 18C, since the operation of the pixel circuit P for the writing period Twrt and the display period dsp becomes the same as that of the fifth embodiment shown in FIGS. 14B and 14C, the same effects as the fifth embodiment can be obtained in the present aspect. In addition, according to the present aspect, since the first switching element T1 and the second switching element T2 are controlled by the common signal (first control signal S1[i]), the structure can be simplified, as compared with a case in which each of the first switching element T1 and the second switching element T2 is controlled by an individual signal.

Third Aspect

Figure 19:
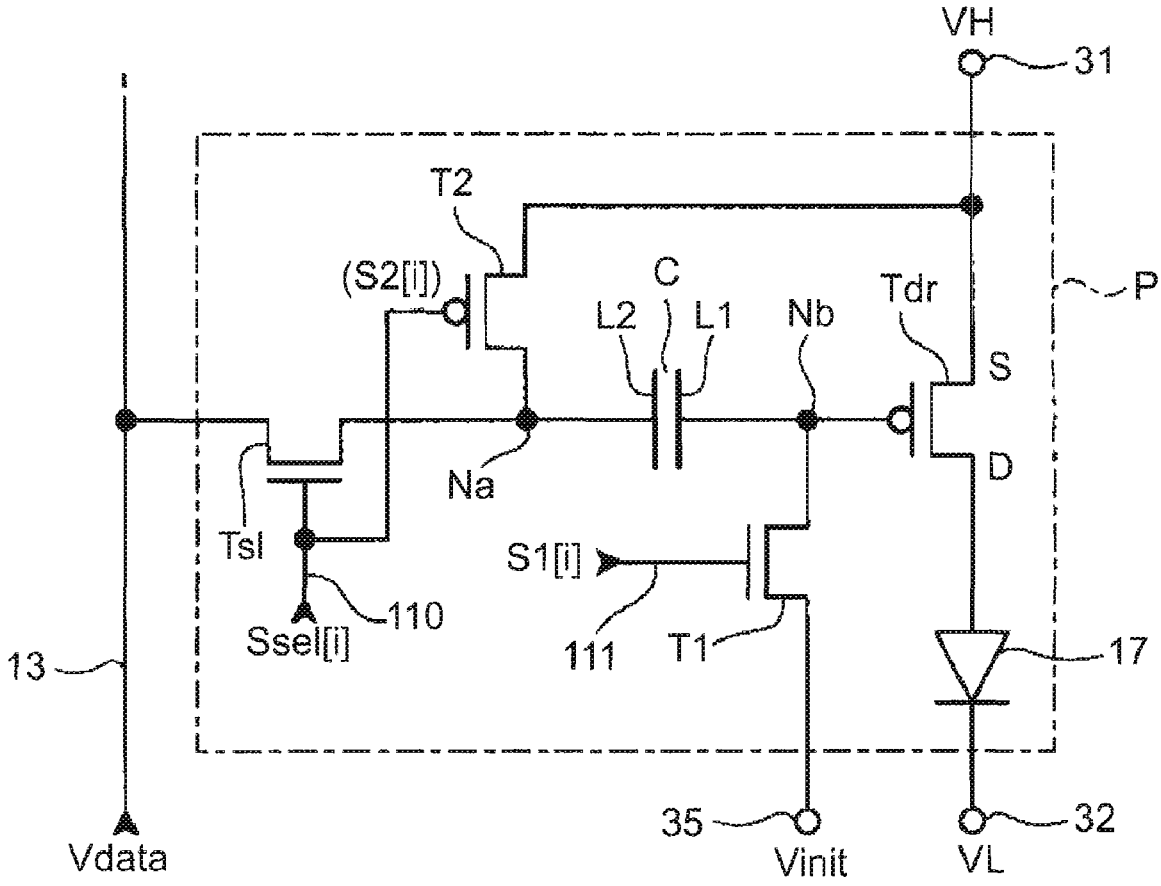
FIG. 19 is a circuit diagram illustrating a structure of a pixel circuit according to a third aspect.

As shown in FIG. 19, the gate terminal of the second switching element T2 and the gate terminal of the selecting transistor Ts1 may be connected to the scanning line 110, and thus the scanning signal Ssel [i] may also serve as the second control signal S2[i]. In addition, the second switching element T2 is a p-channel-type transistor. In this configuration, each of the signals, which are supplied to the pixel circuits P, has the same waveform as the second aspect (FIG. 17) In addition, an equivalent circuit of the pixel circuit P for each period is the same as that of the fifth embodiment (FIG. 14). According to the third aspect, in addition to the same effects as the first embodiment, the structure can be simplified, as compared with a case in which each of the selecting transistor Ts1 and the second switching element T2 is controlled by an individual signal.

Fourth Aspect

Figure 20:
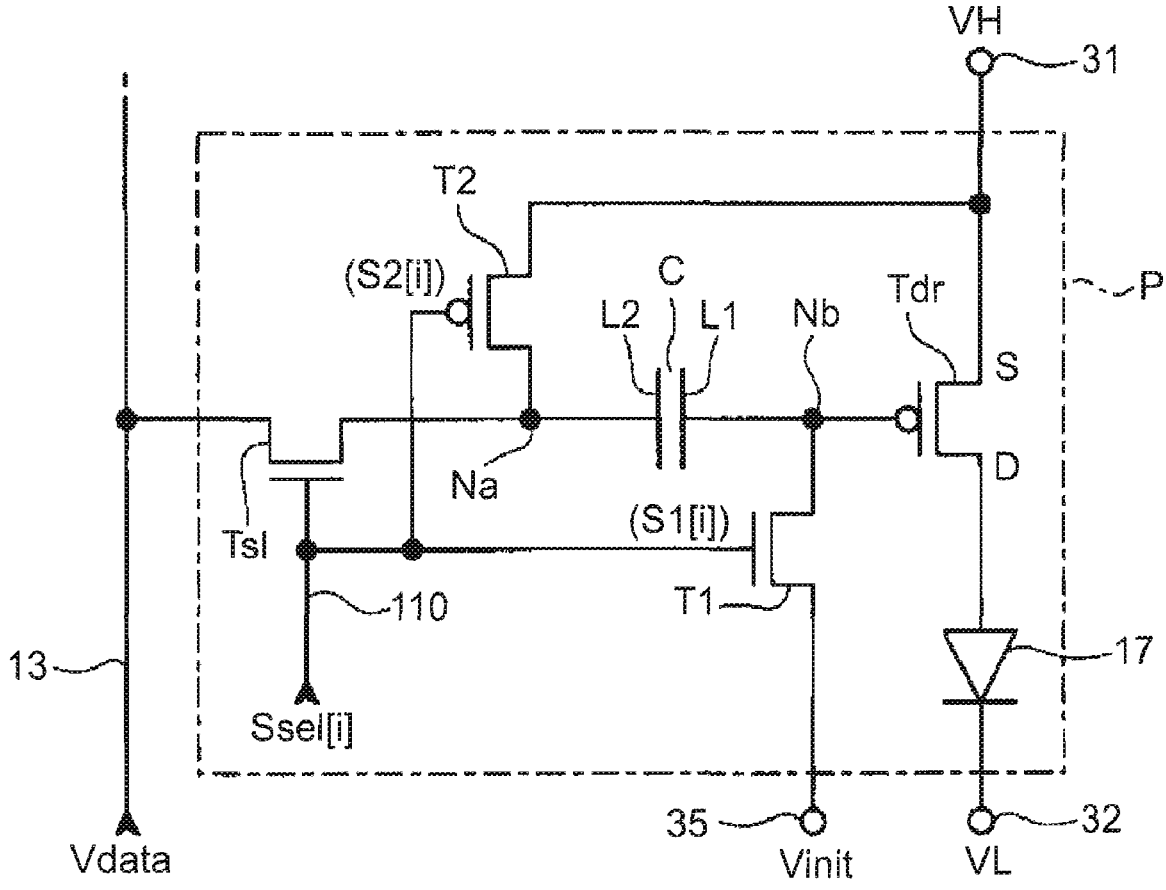
FIG. 20 is a circuit diagram illustrating a structure of a pixel circuit according to a fourth aspect.

The above-mentioned first to third aspects may be properly combined with each other. For example, as shown in FIG. 20, the gate terminal of each of the first switching element T1 and the second switching element T2 and the gate terminal of the selecting transistor Ts1 may be connected to the scanning line 110. In the fourth aspect, the scanning signal Ssel [i] also serves as the first control signal S1[i] an the second control signal S2[i]. In addition, in the present aspect, similar to the second and third aspects, the second switching element T2 is a p-channel-type transistor.

Figure 21:
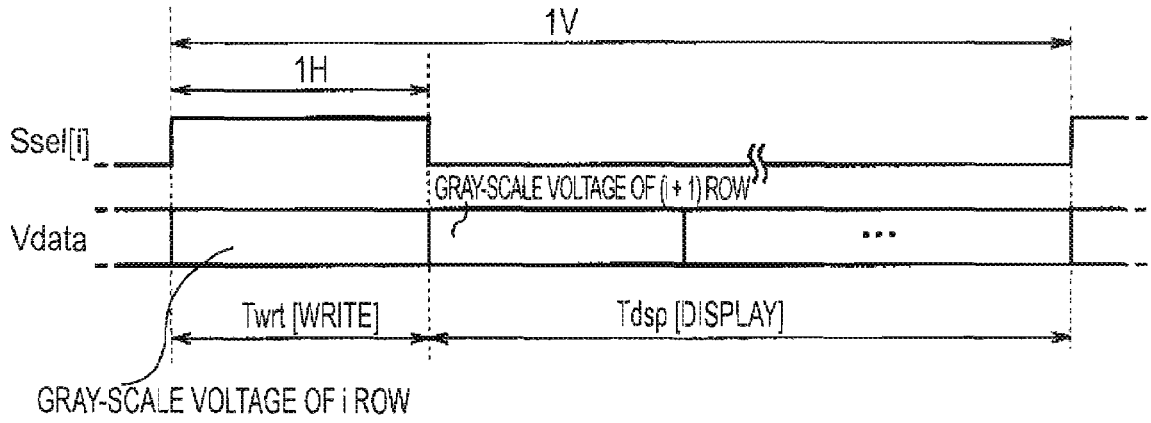
FIG. 21 is a timing chart illustrating a waveform of each signal supplied to the pixel circuit shown in FIG. 20.

As shown in FIG. 21, the scanning signal Ssel [i] according to the present aspect has the same waveform as the scanning signal Ssel [i] according to the first embodiment. In addition, an equivalent circuit of the pixel circuit P for each period is the same as that of the first aspect. According to the present aspect, since the selecting transistor Ts1, the first switching element T1, and the second switching element T2 are controlled by the common signal (scanning signal Ssel [i]), the structure can be simplified, as compared with a case in which each of the selecting transistor Ts1, the first switching element T1, and the second switching element T2 is controlled by an individual signal (fifth embodiment) or a case in which two elements of the selecting transistor Ts1, the first switching element T1, and the second switching element T2 are controlled by a common signal (first to third aspects).

Fifth Aspect

Figure 22:
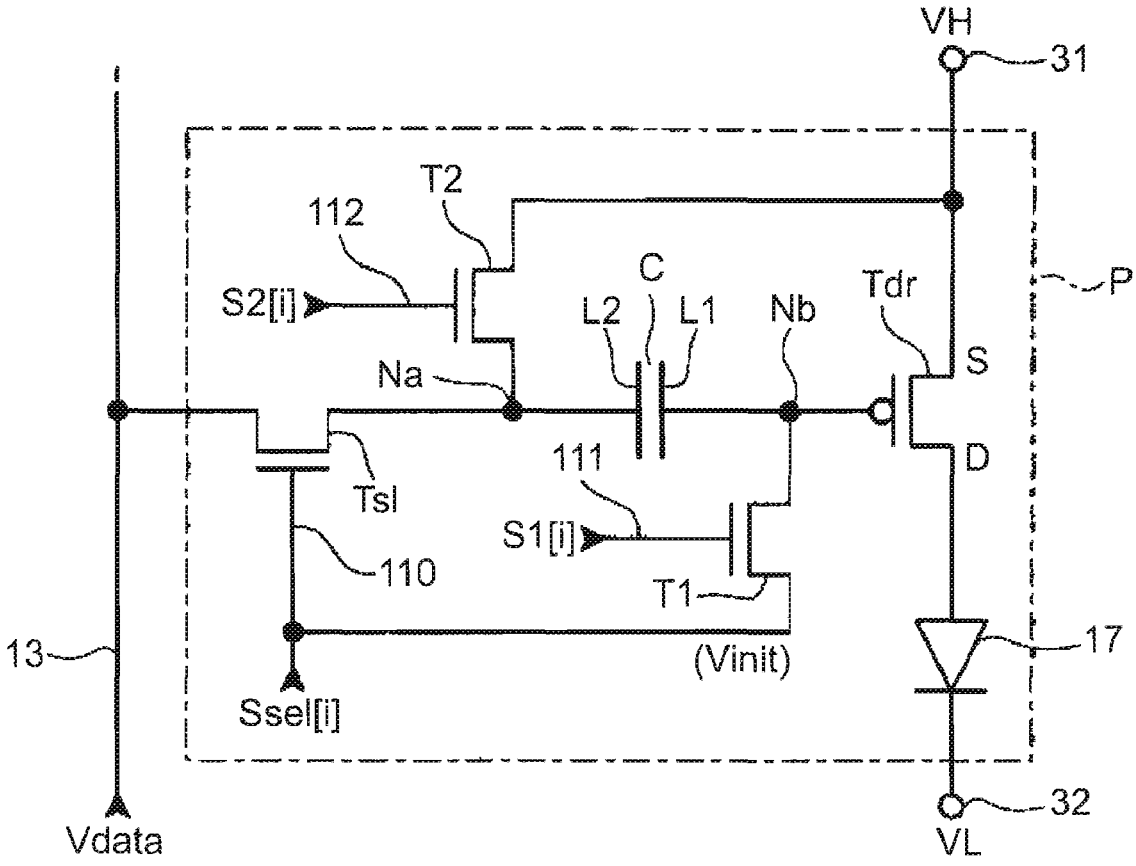
FIG. 22 is a circuit diagram illustrating a structure of a pixel circuit according to a fifth aspect.

As shown in FIG. 22, the drain terminal of the first switching element T1 and the gate terminal of the selecting transistor Ts1 may be connected to the scanning line 110, and thus the scanning signal Ssel [i] for controlling the selecting transistor Ts1 may also serve as the initialization potential Vinit. In this configuration, each of the signals, which are supplied to the pixel circuits P, is the same as that of the first embodiment (FIG. 3).

Figure 23A:
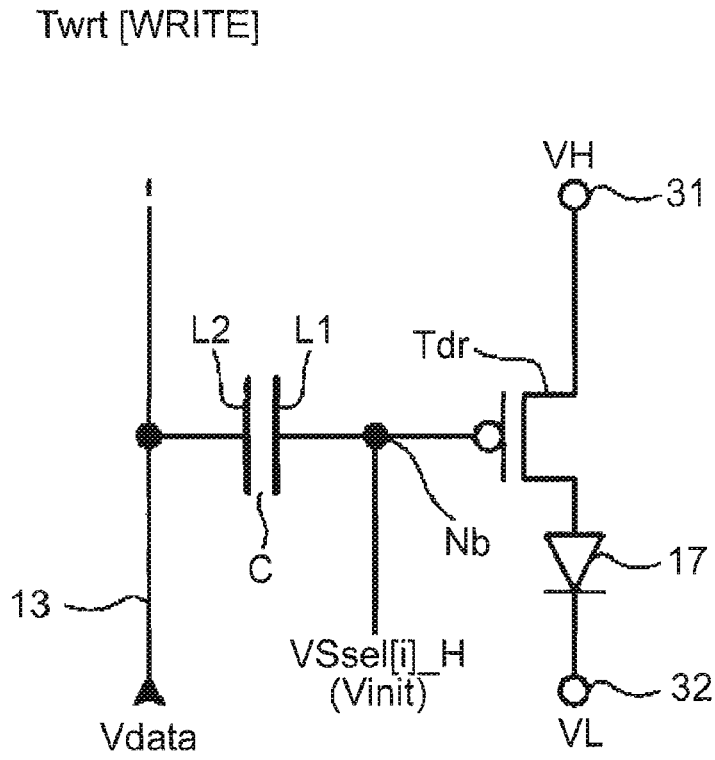
FIG. 23 is a circuit diagram illustrating the operation of the pixel circuit shown in FIG. 22.
Figure 23B:
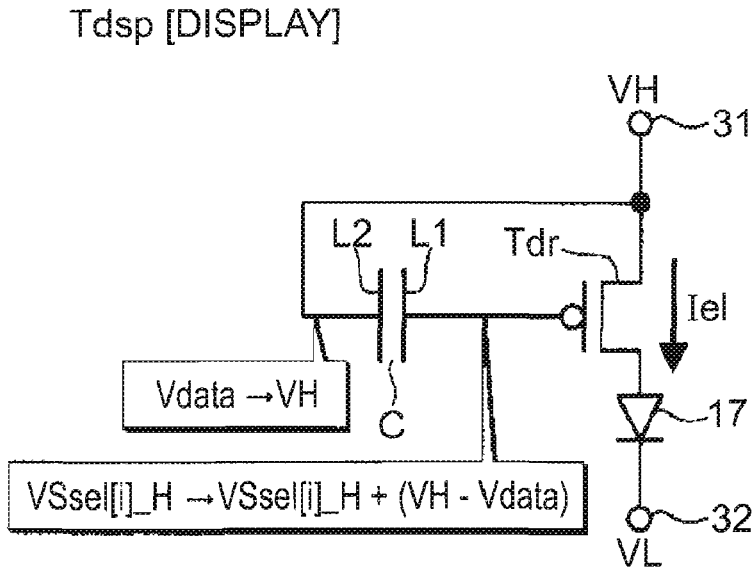

According to the present aspect, as shown in FIG. 23A, for the writing period Twrt, the potential Vsel[i]_H of the scanning signal Ssel [i] of a high level is supplied to the connection point Nb as the initialization potential Vinit. Accordingly, as shown in FIG. 23B, since the potential of the connection point Nb for the display period Tdsp becomes 'VSsel[i]_H+(VH−Vdata)', the current Ie1, which flows through the light-emitting element 17 for the display period Tdsp, is represented by the following Equation (2d).

$$Ie1=(1/2)\beta(Vdata-VSsel[i]_H-Vth)^2 \quad \text{[Equation 2d]}$$

Accordingly, even in the present aspect, since the current Ie1 does not depend on the potential VH or the potential VL, the same effect as the first embodiment can be obtained. In addition, according to the present aspect, since the initialization potential Vinit does not need to be separately generated, the configuration can be simplified.

Sixth Aspect

Figure 24:
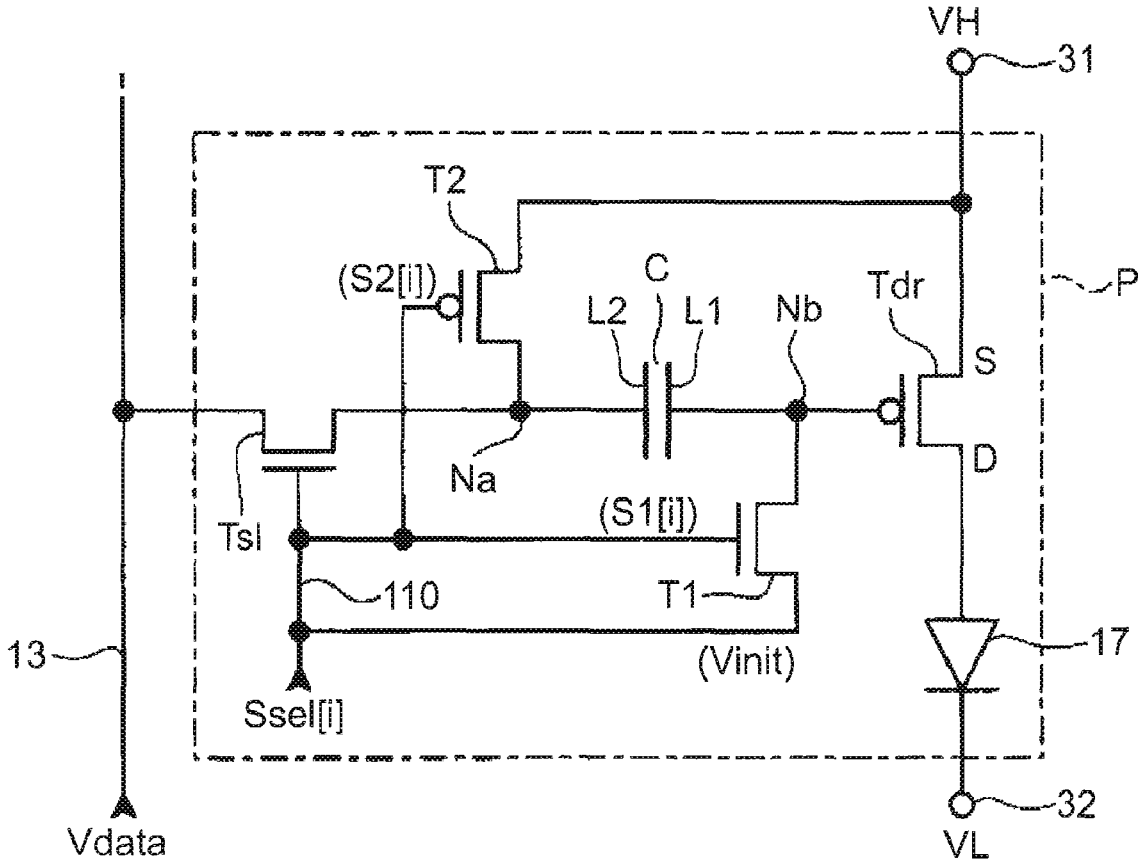
FIG. 24 is a circuit diagram illustrating a structure of a pixel circuit according to a sixth aspect.

The above-mentioned first to fifth aspects may be properly combined with each other. For example, as shown in FIG. 24, the gate terminal and the drain terminal of the first switching element T1 and the gate terminal of the second switching element T2, and the gate terminal of the selecting transistor Ts1 may be connected to the scanning line 110 (that is, a structure in which the fourth aspect shown in FIG. 20 and the fifth aspect shown in FIG. 22 are combined with each other). In this structure, the scanning signal Ssel[i] has the waveform shown in FIG. 21, and the equivalent circuit of the pixel circuit P for each period has the structure shown in FIG. 23. According to the sixth aspect, the structure of the pixel circuit P can be simplified, as compared with the pixel circuits P according to the above-mentioned first to fifth aspects.

Modification

Various modifications may be made for the above-mentioned respective embodiments. Aspects of specific modifications are as follows. In addition, the respective aspects, which will be described in detail below, may be properly combined with each other.

First Modification

In the first to fourth embodiments, all of the switching elements of the pixel circuit P are n-channel types, and in the fifth embodiment, the driving transistor Tdr is a p-channel type. However, a channel type of each switching element of the pixel circuit P is not limited to the above-mentioned channel types, but may be properly changed.

Second Modification

In addition, the above-mentioned respective embodiments may be combined with each other For example, in the first embodiment in which all of the switching elements forming the pixel circuit P are n-channel types, the same structure as the respective aspects of the fifth embodiment may be used.

Third Modification

In the respective embodiments, the light-emitting element 17 using the organic EL material has been exemplified, but the invention is not limited thereto, and the invention can be applied to an electro-optical device using a light-emitting element other than the above-mentioned light-emitting element. For example, the same structure as the various embodiments may be applied to various electro-optical devices, such as a display device using an inorganic EL element, a field emission display (FED), a surface-conduction electron-emitter display (SED), a ballistic electron surface emitting display (BSD), a display device using a light-emitting diode, or the like.

Application

Figure 25:
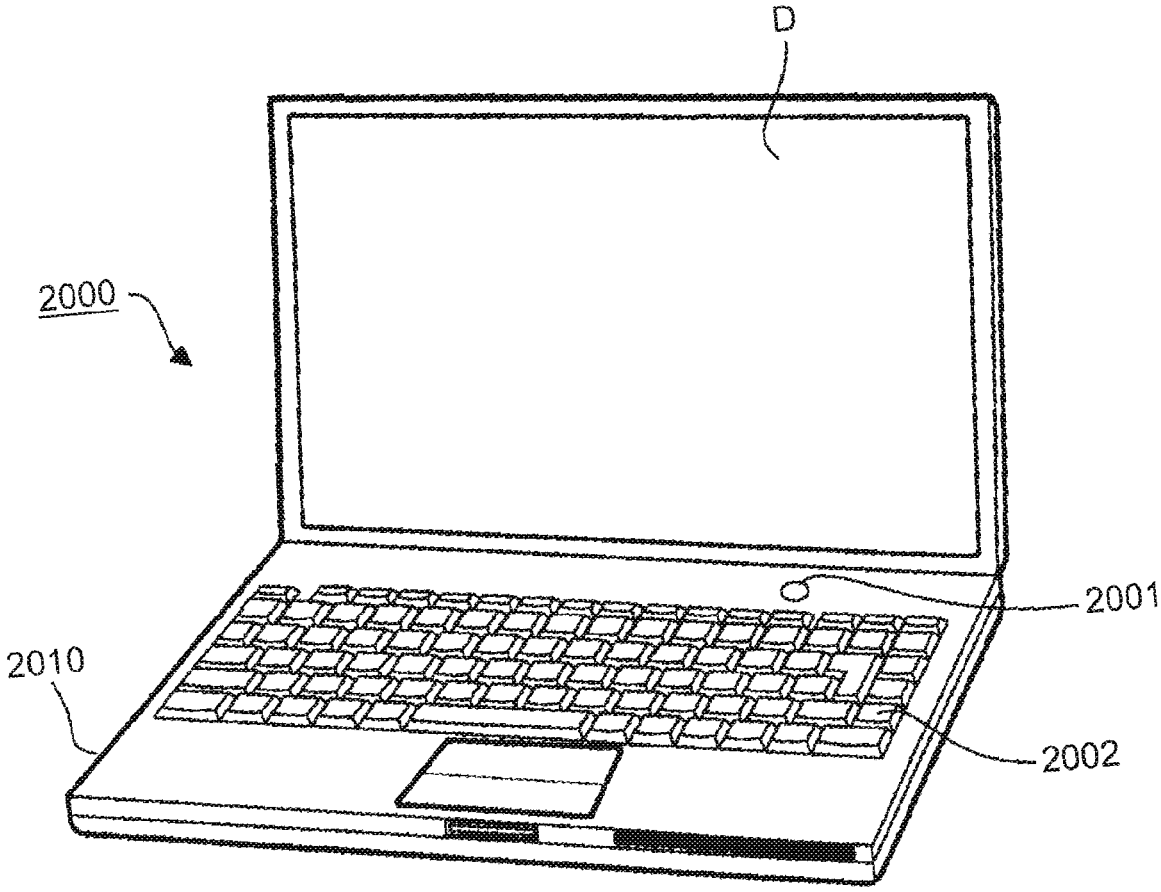
FIG. 25 is a perspective view illustrating a specific form of an electronic apparatus according to an embodiment of the invention.

Next, an electronic apparatus, which uses the above-mentioned electro-optical device, will be described. FIG. 25 is a perspective view illustrating a structure of a mobile personal computer in which an electro-optical device D according to the above-mentioned embodiments is used as a display device. A personal computer 2000 includes an electro-optical device D that serves as the display device, and a main body portion 2010. In the main body portion 2010, a power supply switch 2001 and a keyboard 2002 are provided. In this electro-optical device D, since an organic EL material is used as a forming material of a light-emitting element 17, it is possible to display a screen having a wide viewing angle and clarity.

Figure 26:
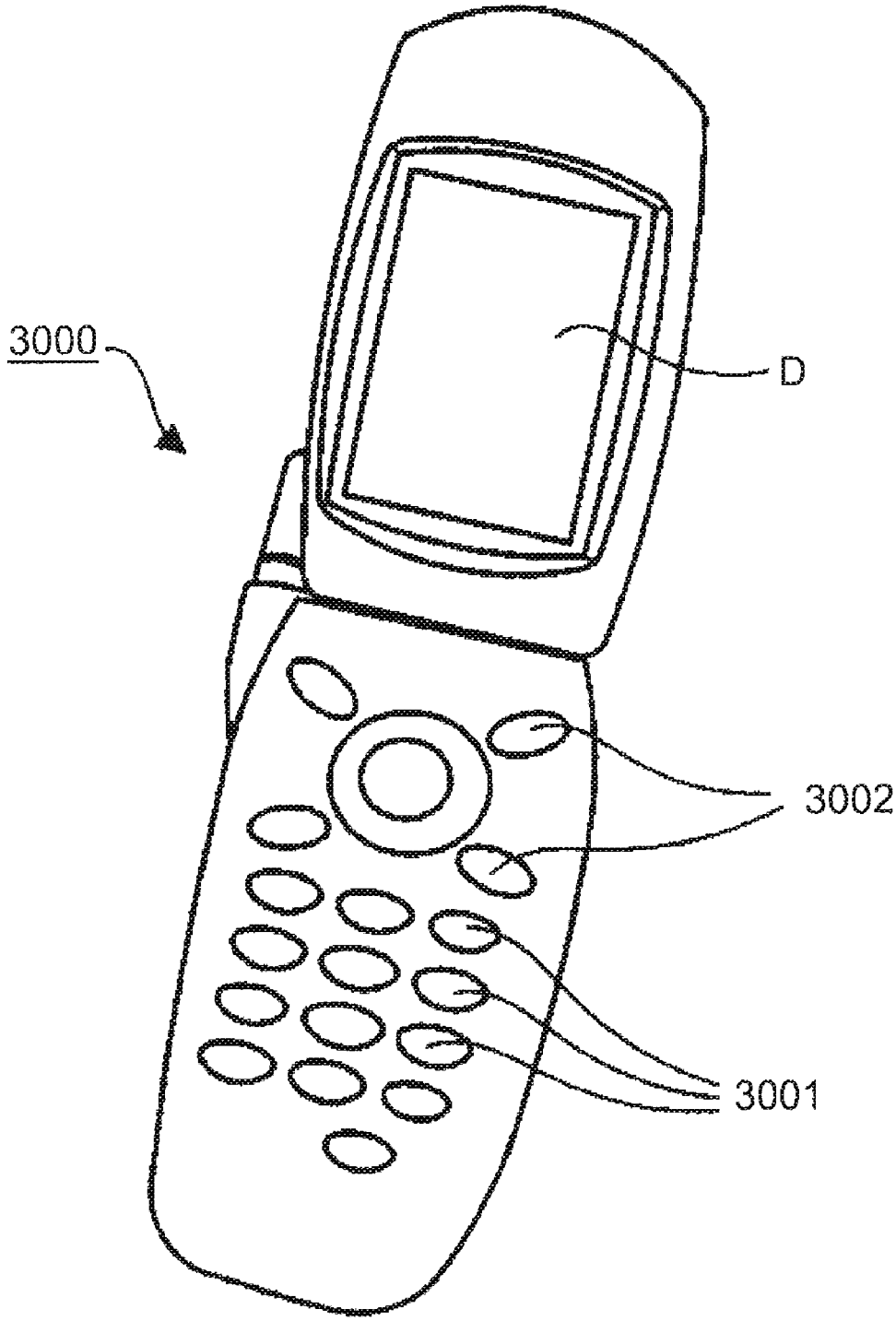
FIG. 26 is a perspective view illustrating a specific form of an electronic apparatus according to another embodiment of the invention.

FIG. 26 is a diagram illustrating a structure of a cellular phone to which the electro-optical device D according to the above-mentioned embodiments is applied. A cellular phone 3000 includes a plurality of operation buttons 3001, a plurality of scroll buttons 3002, and an electro-optical device D that serves as a display device. The scroll button 3002 is operated, and thus a screen displayed on the electro-optical device D is scrolled.

Figure 27:
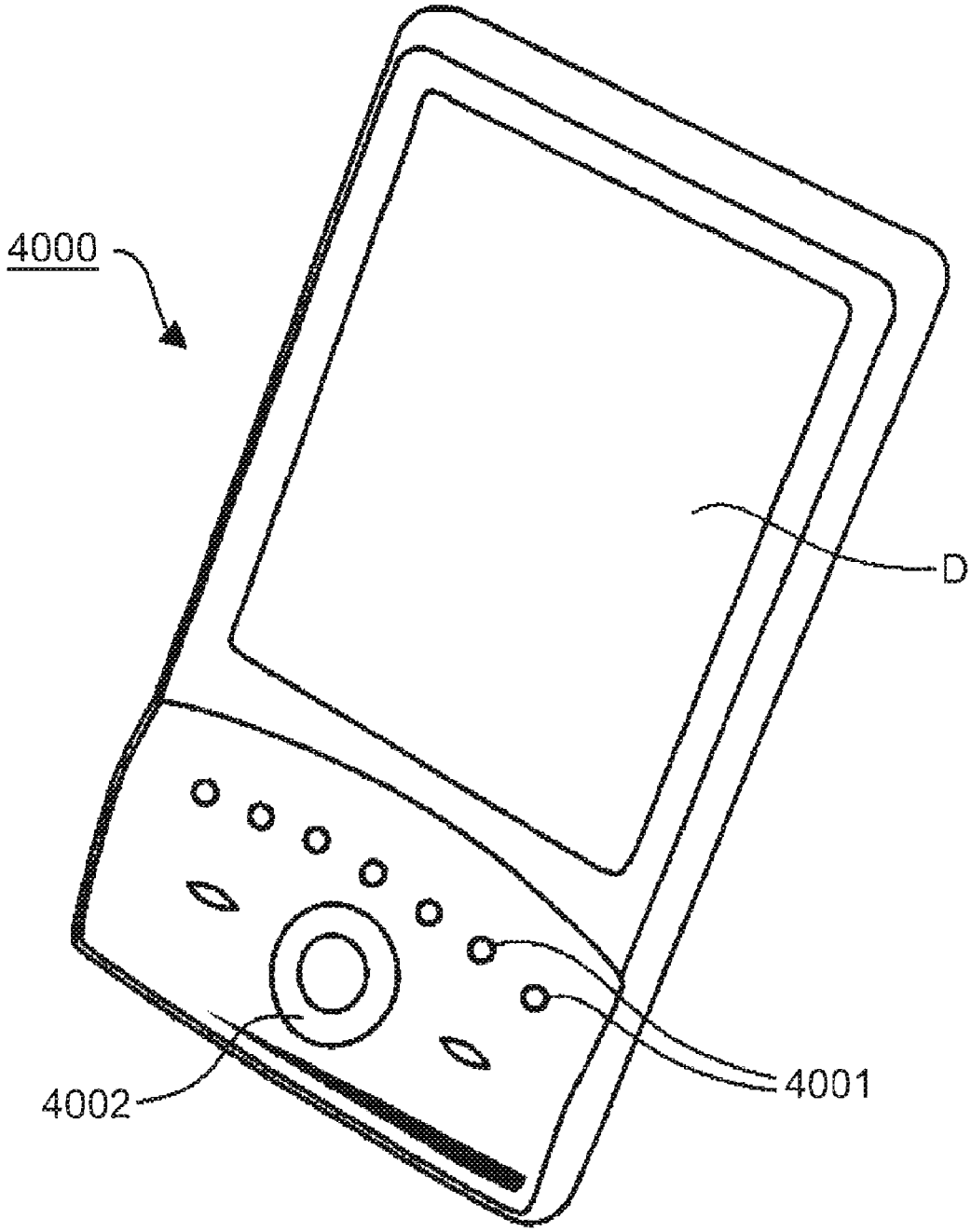
FIG. 27 is a perspective view illustrating a specific form of an electronic apparatus according to another embodiment of the invention.
Figure 28:
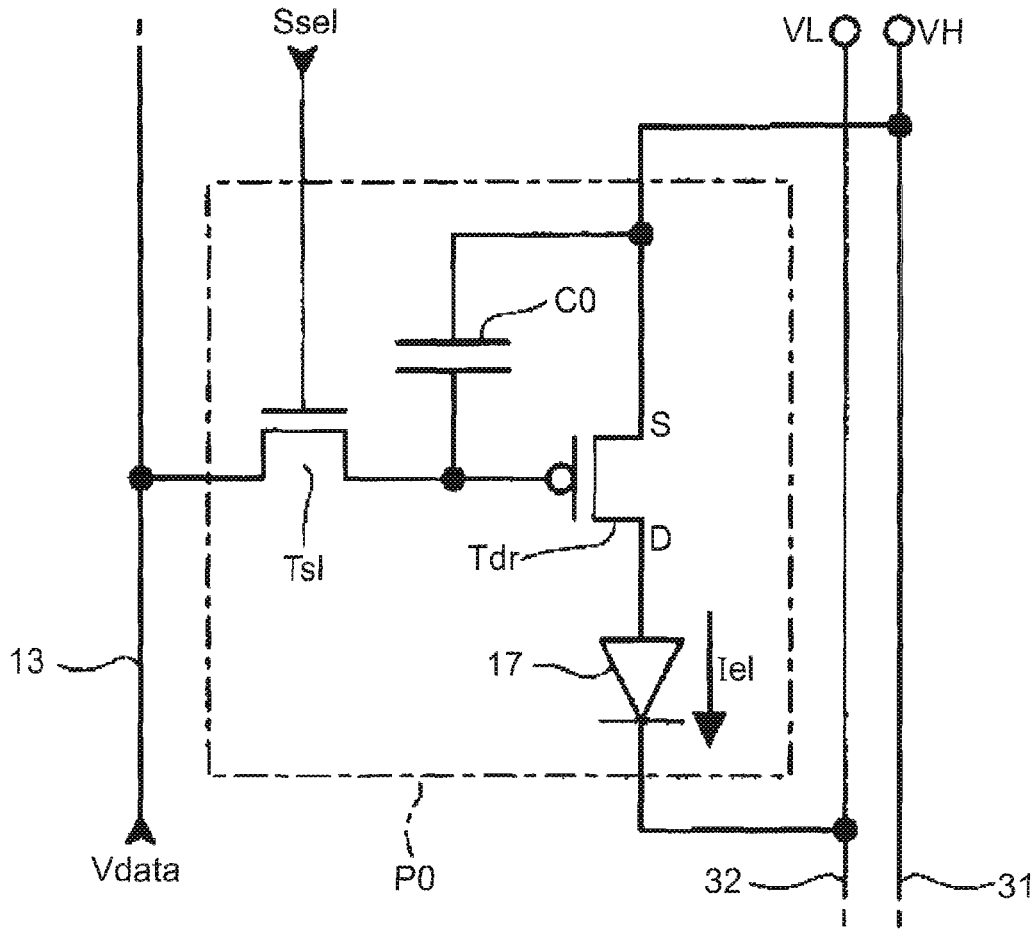
FIG. 28 is a circuit diagram illustrating the problem according to the related art.

FIG. 27 is a diagram illustrating a structure of a personal digital assistant (PDA) to which an electro-optical device D according to the above-mentioned embodiments is applied. A personal digital assistant 4000 includes a plurality of operation buttons 4001, a power supply switch 4002, and an electro-optical device D that serves as a display device. If the power supply switch 4002 is operated, various information, such as an address book, a date book, or the like, is displayed on the electro-optical device D.

In addition to the electronic apparatuses shown in FIGS. 25 to 27 as the electronic apparatus to which the electro-optical device according to the embodiments of the invention is applied, examples of the electronic apparatus may include a digital still camera, a television, a video camera, a car navigation device, a pager, an electronic note, an electronic paper, an electronic calculator, a word processor, a workstation, a video phone, a POS terminal, a printer, a scanner, a copy machine, a video player, an apparatus having a touch panel, or the like. In addition, the electro-optical device is not limited to the image display. For example, in an image forming apparatus, such as an optical writing printer or an electronic copying machine, a writing head has been used in which a photoreceptor is exposed according to an image to be formed on a recording material, such as paper. However, the electro-optical device according to the embodiments of the invention may be used for the writing head. The electronic circuit is a concept that includes the pixel circuit that forms the pixel of the display device as in the above-mentioned embodiments and a circuit that becomes a unit of exposure in an image forming apparatus.

The entire disclosure of Japanese Patent Application No. 2005-120771, filed Apr. 19, 2005 is expressly incorporated by reference herein.

What is claimed is:

1. A method of driving an electronic circuit, the electronic circuit including a light-emitting element that is interposed between a first electric supply line and a second electric supply line having different potentials and emits light by the supply of a current, a storage capacitor that holds a voltage between a first electrode and a second electrode, and a driving transistor that is interposed between the first electric supply line and the second electric supply line and has a gate terminal connected to the first electrode of the storage capacitor, the method comprising:

for a first period, applying a data potential according to a gray-scale level designated for the light-emitting element to the second electrode of the storage capacitor while electrically connecting an initialization wiring line supplied with an initialization potential to the first electrode of the storage capacitor; and for a second period subsequent to the first period, electrically connecting the second electrode of the storage capacitor to a source terminal of the driving transistor.

2. The method of driving an electronic circuit according to claim 1, wherein the initialization potential is set to a level which allows the driving transistor to be turned off.

3. An electronic circuit comprising:

a light-emitting element that is interposed between a first electric supply line and a second electric supply line having different potentials and emits light by the supply of a current;

a storage capacitor that holds a voltage between a first electrode and a second electrode;

a driving transistor that is interposed between the first electric supply line and the second electric supply line and has a gate terminal connected to the first electrode of the storage capacitor;

a selecting switching element that switches an electrically conductive state and an electrically non-conductive state between a data line and the second electrode of the storage capacitor, the data line being supplied with a data potential according to a gray-scale level designated for the light-emitting element;

a first switching element that switches an electrically conductive state and an electrically non-conductive state between a first terminal and a second terminal, the first terminal being connected to an initialization wiring line supplied with an initialization potential, the second terminal being connected to the first electrode of the storage capacitor; and a second switching element that switches an electrically conductive state and an electrically non-conductive state between a first terminal and a second terminal, the first terminal being connected to the second electrode of the storage capacitor, the second terminal being connected to a source terminal of the driving transistor.

4. The electronic circuit according to claim 3, wherein the initialization potential is set to a level which allows the driving transistor to be turned off.

5. The electronic circuit according to claim 3, wherein each of the driving transistor, the selecting switching element, the first switching element, and the second switching element is composed of an n-channel-type transistor.

6. The electronic circuit according to claim 3, wherein the selecting switching element is turned on for a part or all of a first period in accordance with a scanning signal supplied to the corresponding selecting switching element and turned off for a second period subsequent to the first period, the first switching element is turned on for the first period in accordance with a first control signal supplied to the corresponding first switching element and turned off for the second period, and the second switching element is turned off for the first period in accordance with a second control signal supplied to the corresponding second switching element and turned on for the second period.

7. The electronic circuit according to claim 6, wherein the first switching element is turned on for both an initialization period and a writing period right after the initialization period, all of which are included in the first period, and the selecting switching element is turned off for the initialization period and turned on for the writing period.

8. The electronic circuit according to claim 6, wherein the scanning signal is supplied to the selecting switching element and to the first switching element as the first control signal.

9. The electronic circuit according to claim 6, wherein each of the first switching element and the second switching element is composed of a different channel type transistor, and the first control signal is supplied to the first switching element and to the second switching element as the second control signal.

10. The electronic circuit according to claim 6, wherein each of the second switching element and the selecting switching element is composed of a different channel type transistor, and the scanning signal is supplied to the selecting switching element and to a gate terminal of the second switching element as the second control signal.

11. The electronic circuit according to claim 6, wherein the second switching element is composed of a different channel type transistor from the selecting switching element and the first switching element, and the scanning signal is supplied to the first switching element as the first control signal and to the second switching element as the second control signal.

12. The electronic circuit according to claim 6, wherein the scanning signal is supplied to the selecting switching element and to the initialization writing line as the initialization potential.

13. The electronic circuit according to claim 6, wherein the second control signal is supplied to the second switching element and to the initialization wiring line as the initialization potential.

14. An electro-optical device comprising:

a plurality of the electronic circuits according to claim 3, which are disposed in a matrix;

a driving circuit that drives each of the electronic circuits so as to allow the light-emitting element to emit light.

15. The electro-optical device according to claim 14, wherein the selecting switching element of each electronic circuit is turned on for a part or all of a first period in accordance with a scanning signal supplied from the driving circuit and turned off for a second period subsequent to the first period, and a scanning signal, which is supplied from the driving circuit to a selecting switching element of one electronic circuit, is supplied to an initialization wiring line of another electronic circuit as the initialization potential.

16. An electronic apparatus comprising the electro-optical device according to claim 14.

* * * * *